US012741839B2

(12) United States Patent
Kii

(10) Patent No.: US 12,741,839 B2
(45) Date of Patent: Sep. 22, 2026

(54) SKEW CORRECTION DEVICE AND MEDIUM PROCESSING APPARATUS

(71) Applicant: SEIKO EPSON CORPORATION, Tokyo (JP)

(72) Inventor: Soichiro Kii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 331 days.

(21) Appl. No.: 18/331,654

(22) Filed: Jun. 8, 2023

(65) Prior Publication Data

US 2023/0399188 A1 Dec. 14, 2023

(30) Foreign Application Priority Data

Jun. 10, 2022 (JP) ..... 2022-094199

(51) Int. Cl.
*B65H 9/00* (2006.01)
*B65H 5/06* (2006.01)

(52) U.S. Cl.
CPC ..... *B65H 9/002* (2013.01); *B65H 5/06* (2013.01); *B65H 2301/331* (2013.01); *B65H 2301/42262* (2013.01); *B65H 2402/20* (2013.01); *B65H 2403/72* (2013.01); *B65H 2404/1115* (2013.01)

(58) Field of Classification Search
CPC ... B65H 9/006; B65H 9/008; B65H 2404/166
See application file for complete search history.

(56) References Cited

U.S. PATENT DOCUMENTS 5,609,428 A 3/1997 Tanaka
11,884,506 B2 * 1/2024 Umi ..... B65H 5/062
2005/0263956 A1 12/2005 Uchida
2009/0096153 A1 * 4/2009 Katsura ..... B65H 3/5261 271/10.11
2017/0282603 A1 10/2017 Maeda
2018/0093499 A1 4/2018 Shirane
2022/0081240 A1 3/2022 Umi et al.

FOREIGN PATENT DOCUMENTS

JP H08091633 A 4/1996
JP H09-235041 A 9/1997
JP 2005-154100 A 6/2005
JP 2005-343645 A 12/2005
JP 2005335915 12/2005
JP 2017186114 10/2017
JP 2017197307 11/2017
JP 2021143074 9/2021

* cited by examiner

*Primary Examiner* — Howard J Sanders
(74) *Attorney, Agent, or Firm* — WORKMAN NYDEGGER

(57) ABSTRACT

A skew correction device is configured to transport a medium through regular rotation of a resist roller and correct skew of the medium through reverse rotation or stoppage of the resist roller. The skew correction device includes the resist roller, a driven roller configured to transport the medium by nipping the medium together with the resist roller and correct skew of the medium, and a driving force transmission unit configured to transmit a driving force from a driving source to the resist roller, wherein the driving force transmission unit includes a torque limiter configured to regularly rotate the resist roller by transmitting a driving source from the driving source, and a clutch configured to perform switching between a state of regularly rotating the resist roller and a state of reversely rotating or stopping the resist roller.

17 Claims, 6 Drawing Sheets

SKEW CORRECTION DEVICE AND MEDIUM PROCESSING APPARATUS

The present application is based on, and claims priority from JP Application Serial Number 2022-094199, filed Jun. 10, 2022, the disclosure of which is hereby incorporated by reference herein in its entirety.

BACKGROUND

1. Technical Field

The present disclosure relates to a skew correction device and a medium processing apparatus.

2. Related Art

Examples of the device of this kind includes one described in JP-A-2005-343645. JP-A-2005-343645 discloses a sheet transport device that corrects skew of a medium by causing a leading edge of a sheet to abut against a reversely-rotated resist roller and transports the sheet downstream after an elapse of a predetermined time period by regularly rotating the resist roller. In this case, the resist roller is driven in a regular rotation direction via a clutch, and is driven in a reverse rotation direction via a torque limiter.

Recently, it has been demanded to achieve high-speed transport and skew correction of a medium. In the above-mentioned related art, the medium is transported while the torque limiter is idly rotated in a state in which the clutch transmits a driving force. However, with this configuration, a load is applied to the torque limiter at the time of transport performed by regularly rotating the resist roller, which disadvantageously affects increase in speed. In other words, with a torque from the same driving source, a driving force is lost by an amount corresponding to a load applied to the torque limiter, and hence a load applied to the driving source is increased as a speed is increased.

SUMMARY

In order to solve the above-mentioned problem, a skew correction device according to the present disclosure is configured to transport a medium through regular rotation of a resist roller and correct skew of the medium through reverse rotation or stoppage of the resist roller. The skew correction device includes the resist roller, a driven roller configured to transport the medium by nipping the medium together with the resist roller and correct skew of the medium, and a driving force transmission unit configured to transmit a driving force from a driving source to the resist roller, wherein the driving force transmission unit includes a torque limiter configured to regularly rotate the resist roller by transmitting a driving source from the driving source, and a clutch configured to perform switching between a state of regularly rotating the resist roller and a state of reversely rotating or stopping the resist roller.

Further, a medium processing apparatus according to the present disclosure includes a skew correction device of an eleventh mode, a thirteenth mode, or a sixteenth mode described later, a driving source configured to drive the resist roller, an upstream transport unit configured to transport the medium to the skew correction device, a downstream transport unit configured to transport the medium after skew correction performed by the skew correction device, and a processing unit configured to execute processing on the medium transported by the downstream transport unit.

Further, a skew correction device according to the present disclosure is configured to transport a medium through regular rotation of a resist roller and correct skew of the medium through reverse rotation or stoppage of the resist roller. The skew correction device includes the resist roller, a driven roller configured to transport the medium by nipping the medium together with the resist roller and correct skew of the medium, and a driving force transmission unit configured to transmit a driving force from a driving source to the resist roller, wherein the driving force transmission unit includes a first clutch being in a coupling state of transmitting a driving force at the time of regular rotation of the resist roller and being in a cut-off state of not transmitting a driving force at the time of reverse rotation of the resist roller, a second clutch being in a cut-off state of not transmitting a driving force at the time of regular rotation of the resist roller and being in a coupling state of transmitting a driving force at the time of reverse rotation of the resist roller, an idle gear being engaged with the second clutch and being configured to transmit a driving force from the driving source to the second clutch, a first toothed gear being engaged with the first clutch and being configured to transmit a driving force from the driving source to the first clutch, and a second toothed gear being engaged with the idle gear and being configured to transmit a driving force from the driving source to the idle gear, the first clutch and the second clutch are coaxially provided, the first toothed gear and the second toothed gear are coaxially provided, one of the first toothed gear and the second toothed gear receives a driving force from the driving source, and another one of the first toothed gear and the second toothed gear is integrally rotated with the one thereof.

Further, a medium processing apparatus according to the present disclosure includes a skew correction device of a twentieth mode described later, a driving source configured to drive the resist roller, an upstream transport unit configured to transport the medium to the skew correction device, a downstream transport unit configured to transport the medium after skew correction performed by the skew correction device, and a processing unit configured to execute processing on the medium transported by the downstream transport unit.

DESCRIPTION OF EXEMPLARY EMBODIMENTS

Figure 1:
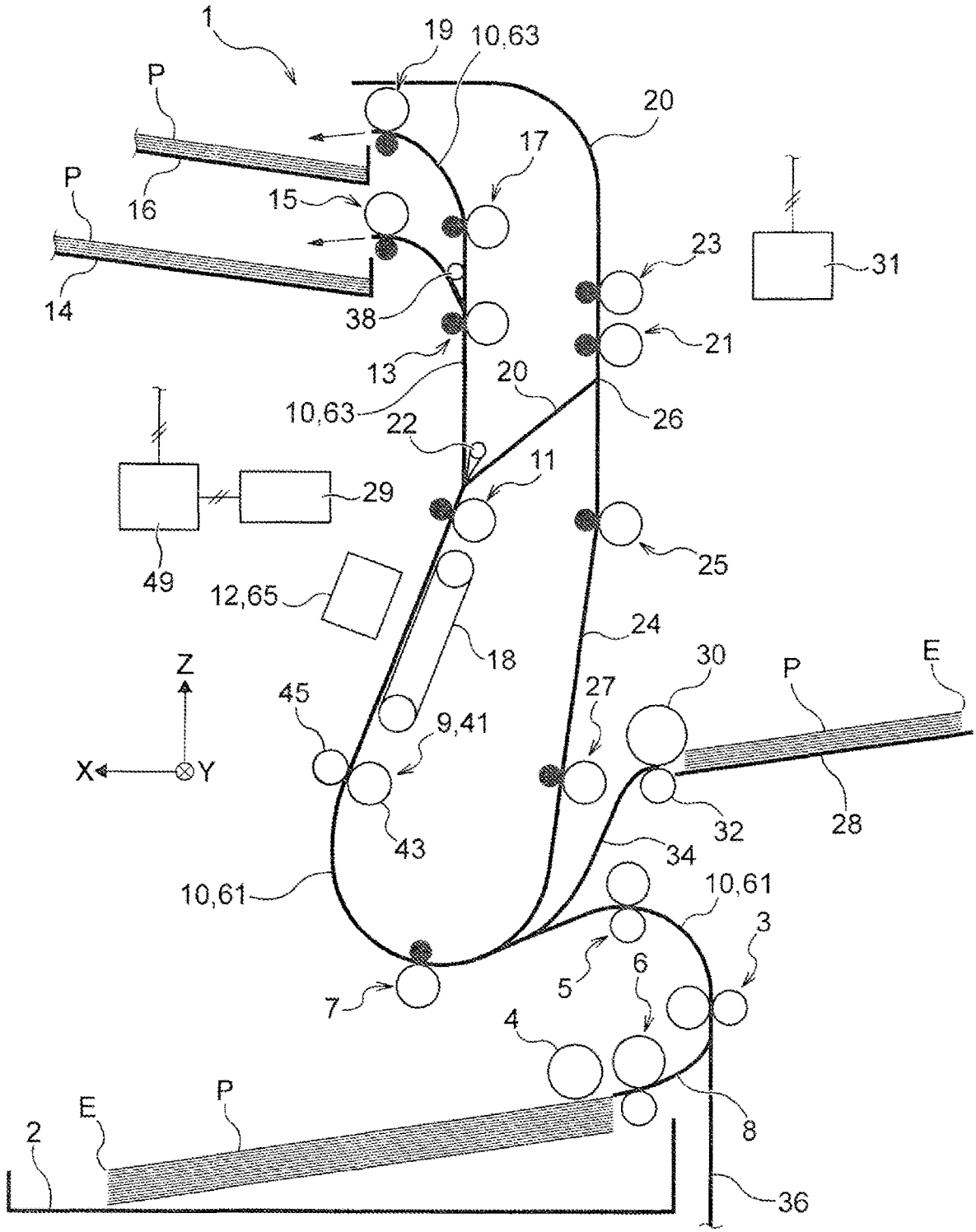
FIG. 1 is a view illustrating a transport path of a medium processing apparatus according to a first exemplary embodiment.

First, the present disclosure is schematically described below.

In order to solve the above-mentioned problem, a skew correction device according to a first mode of the present disclosure is configured to transport a medium through regular rotation of a resist roller and correct skew of the medium through reverse rotation or stoppage of the resist roller. The skew correction device includes the resist roller, a driven roller configured to transport the medium by nipping the medium together with the resist roller and correct skew of the medium, and a driving force transmission unit configured to transmit a driving force from a driving source to the resist roller, wherein the driving force transmission unit includes a torque limiter configured to regularly rotate the resist roller by transmitting a driving source from the driving source, and a clutch configured to perform switching between a state of regularly rotating the resist roller and a state of reversely rotating or stopping the resist roller.

Here, the expression "correct skew" in "correct skew of the medium" indicates that skew of the medium is not required to be eliminated in a strict sense.

According to the present mode, the driving force transmission unit includes the torque limiter and the clutch. With this, the clutch is in a state capable of regularly rotating the resist roller, and thus the resist roller is regularly rotated. In other words, a driving force in the regular rotation direction is transmitted to the resist roller via the torque limiter, and thus the resist roller is regularly rotated.

When the resist roller is reversely rotated or stopped so as to perform the skew correction, the clutch is switched to a state of reversely rotating or stopping the resist roller. In other words, the torque limiter exceeds a set torque, and thus is in a slip state. With this, transmission of a driving force in the regular rotation direction is blocked, and the reverse rotation or stoppage is achieved. With this, a load applied from the resist roller at the time of regular rotation transport can be suppressed. Further, the clutch and the torque limiter can be prevented from being worn, and durability is improved.

Further, a cost can be reduced as compared to a configuration in which a plurality of clutches are used as the driving force transmission unit in place of the torque limiter. Further, the torque limiter always achieves a state in which a gap in the driving force transmission unit (hereinafter, also referred to as "backlash") is suppressed. Thus, degradation of correction accuracy, which is caused by generation of noise due to backlash at the time of switching the rotation directions and movement of the resist roller due to backlash at the time of correcting skew of the medium (hereinafter, also referred to as "skew correction"), can be suppressed.

Further, the clutch has a time lag from transmission of an instruction for coupling or cutting-off to actual completion of coupling or cutting-off. Thus, in a configuration in which a plurality of clutches are used in place of the torque limiter, another clutch cannot be controlled until one of the clutches completes coupling or cutting-off.

However, in the present mode, the one of those is the torque limiter. With this, the rotation direction is naturally switched due to a relationship between a load applied from the clutch and a set torque of the torque limiter. In other words, a time lag generated at the time of switching the rotation directions can be suppressed.

Further, in a configuration in which a motor is regularly rotated or reversely rotated, a time period required for acceleration of the motor needs to be considered at the time of control. However, in the present mode, there is no need to consider a time period required for acceleration of the motor, and hence a throughput can be improved.

According to a second mode of the present disclosure, in the skew correction device of the first mode, the resist roller is configured to rotate about a roller shaft integrally with the roller shaft, and the torque limiter and the clutch are provided to the roller shaft.

According to the present mode, the torque limiter and the clutch is provided to the roller shaft. Thus, driving force transmission loss can be suppressed, and size reduction can be achieved.

According to a third mode of the present disclosure, in the skew correction device of the first mode or the second mode, the torque limiter and the clutch are provided on the same side with respect to a center of the roller shaft.

According to the present mode, the torque limiter and the clutch are provided on the same side with respect to the center of the roller shaft. Thus, a space can be saved, and assembly can also be facilitated.

According to a fourth mode of the present disclosure, in the skew correction device of any one of the first mode to the third mode, the resist roller is a toothed roller. Here, the "toothed roller" indicates a roller that has a plurality of protrusions on an outer surface. The protrusions contact with a medium, and thus establishes a point contact state in a contact area with the medium.

When the resist roller is the toothed roller, there arises a problem in that the resist roller has an easily-rotated structure at the time of entry of the medium as compared to a resist roller without protrusions.

However, according to the present mode, the resist roller is in a state in which the torque limiter always suppresses backlash. Thus, skew correction can effectively be performed without being affected by the problem caused by movement of the resist roller due to backlash.

In particular, in a configuration in which the medium is subjected to skew correction again by the resist roller for duplex printing, the toothed roller is used to suppress a transfer.

According to a fifth mode of the present disclosure, the skew correction device of any one of the first mode to the fourth mode further includes a regulation unit being engaged with the clutch and being configured to regulate rotation of the clutch, wherein skew of the medium is corrected in a state in which the resist roller is stopped.

According to the present mode, the clutch is engaged with the regulation unit, and thus rotation of the clutch is regulated and stopped. When rotation of the clutch is stopped, rotation of the resist roller is also stopped. With this, skew can be corrected in a state in which the resist roller is stopped.

Further, the clutch applies a brake to stop the resist roller. With this, as compared to a configuration without the clutch or a configuration in which the torque limiter stops the resist roller, a torque for suppressing rotation of the resist roller is higher. With this, the medium can be prevented from passing through, and hence accuracy of skew correction is improved.

According to a sixth mode of the present disclosure, in the skew correction device of any one of the first mode to the fourth mode, the clutch is a reverse-rotation clutch configured to reverse rotation of the resist roller, the driving force transmission unit includes an idle gear configured to transmit a driving force from the driving source to the reverse-rotation clutch, and skew of the medium is corrected in a state in which the resist roller is reversely rotated.

According to the present mode, the idle gear transmits a driving force so that the reverse-rotation clutch reversely rotates the resist roller. With this, the torque limiter exceeds a set torque, and thus is in a slip state. With this, transmission of a driving force in the regular rotation direction is blocked, and skew correction can be performed in a state in which the reverse-rotation clutch reversely rotates the resist roller.

According to a seventh mode of the present disclosure, in the skew correction device of the sixth mode, the driving force transmission unit includes a first toothed gear being engaged with the torque limiter and being configured to transmit a driving force from the driving source to the torque limiter, and a second toothed gear being engaged with the idle gear and being configured to transmit a driving force from the driving source to the idle gear, the first toothed gear and the second toothed gear are coaxially provided, one of the first toothed gear and the second toothed gear receives a driving force from the driving source, and another one of the first toothed gear and the second toothed gear is integrally rotated with the one thereof.

According to the present mode, the first toothed gear and the second toothed gear are coaxially provided. Thus, driving force transmission loss can be suppressed, and size reduction can be achieved.

According to an eighth mode of the present disclosure, in the skew correction device of the seventh mode, the second toothed gear has a diameter smaller than that of the first toothed gear.

According to the present mode, the second toothed gear has a diameter smaller than that of the first toothed gear. Thus, a speed of reverse rotation can be reduced without changing a rotation speed of the driving source.

According to a ninth mode of the present disclosure, in the skew correction device of any one of the first mode to the fourth mode, the clutch includes a stoppage clutch configured to stop rotation of the resist roller, and a reverse-rotation clutch being in a cut-off state of not transmitting a driving force at the time of regular rotation of the resist roller and being in a reverse-rotation coupling state of transmitting a driving force at the time of reverse rotation of the resist roller, the driving force transmission unit includes an idle gear being engaged with the reverse-rotation clutch and being configured to transmit a driving force from the driving source to the reverse-rotation clutch, and the idle gear reversely rotates the resist roller in the reverse-rotation coupling state.

According to the present mode, the reverse-rotation clutch is in the cut-off state, and the stoppage clutch stops the resist roller. With this, the torque limiter exceeds a set torque, and thus is in a slip state, and skew correction can be performed in a state in which the resist roller is stopped.

Further, a restriction of the stoppage clutch is canceled to allow the resist roller to be in a rotatable state, and the reverse-rotation clutch is in the reverse-rotation coupling state, With this, the torque limiter exceeds a set torque, and thus is in a slip state, and skew correction can be performed in a state in which the reverse-rotation clutch reversely rotates the resist roller. In other words, a method for skew correction can be selected as appropriate.

According to a tenth mode of the present disclosure, in the skew correction device of the ninth mode, the driving force transmission unit includes a first toothed gear being engaged with the torque limiter and being configured to transmit a driving force from the driving source to the torque limiter, and a second toothed gear being engaged with the idle gear and being configured to transmit a driving force from the driving source to the idle gear, the first toothed gear and the second toothed gear are coaxially provided, one of the first toothed gear and the second toothed gear receives a driving force from the driving source, and another one of the first toothed gear and the second toothed gear is integrally rotated with the one thereof.

According to the present mode, the first toothed gear and the second toothed gear are coaxially provided. Thus, driving force transmission loss can be suppressed, and size reduction can be achieved.

A medium processing apparatus according to an eleventh mode of the present disclosure includes the skew correction device of the fifth mode, a driving source configured to drive the resist roller, an upstream transport unit configured to transport the medium to the skew correction device, a downstream transport unit configured to transport the medium after skew correction performed by the skew correction device, and a processing unit configured to execute processing on the medium transported by the downstream transport unit.

According to the present mode, in the device that executes processing such as printing for the medium, effects based on the skew correction device of the fifth mode can be exerted. At the same time, skew correction can appropriately be performed, and accuracy of the processing can be improved.

According to a twelfth mode of the present disclosure, in the medium processing apparatus of the eleventh mode, the processing unit is a recording unit configured to perform recording on the medium, and the recording unit performs recording on the medium after skew correction performed by the skew correction device.

According to the present mode, skew correction can appropriately be performed before the medium to be subjected to recording is transported to the recording unit, and hence recording accuracy can be improved.

Further, the skew correction device of the fifth mode is used. In other words, the torque limiter is used at the time of regular rotation transport. Thus, when a large transport resistance is caused downstream, the resist roller cannot press the medium by a torque larger than a set torque of the torque limiter. Therefore, it is possible to suppress a problem that, when a jam of the medium is caused in the periphery of the recording unit, the medium is forcefully pressed, is deformed three-dimensionally, and contacts with the recording unit to cause damage.

Similarly, the torque limiter limits a force of pressing the medium from behind, and hence a risk of disturbing a transport state of the medium can be suppressed.

A medium processing apparatus according to a thirteenth mode of the present disclosure includes the skew correction device of the sixth mode, a driving source configured to drive the resist roller, an upstream transport unit configured to transport the medium to the skew correction device, a downstream transport unit configured to transport the medium after skew correction performed by the skew correction device, and a processing unit configured to execute processing on the medium transported by the downstream transport unit.

According to the present mode, in the device that executes processing such as printing for the medium, effects based on the skew correction device of the sixth mode can be exerted. At the same time, skew correction can appropriately be performed, and accuracy of the processing can be improved.

According to a fourteenth mode of the present disclosure, the medium processing apparatus of the thirteen mode further includes a control unit configured to control the skew correction device, wherein the control unit is configured to select between first reverse-rotation skew correction for correcting skew by causing a leading edge of the medium to abut against a resist roller in a state in which the resist roller is reversely rotated, and second reverse-rotation skew correction for correcting skew of the medium by reversely rotating the resist roller after the leading edge of the medium passes through the resist roller.

According to the present mode, the control unit can select between the first reverse-rotation skew correction and the second reverse-rotation skew correction. With this, an appropriate skew correction method is selected in accordance with a type of the medium, contents of the processing, a processing speed, or the like. Thus, skew correction can be performed more effectively. In particular, with a simple configuration, the plurality of skew correction methods can be selected and performed.

According to a fifteenth mode of the present disclosure, in the medium processing apparatus of the fourteenth mode, the processing unit is a recording unit configured to perform recording on the medium, and the recording unit performs recording on the medium after skew correction performed by the skew correction device.

According to the present mode, skew correction can appropriately be performed before the medium to be subjected to recording is transported to the recording unit, and hence recording accuracy can be improved.

Further, the skew correction device of the sixth mode is used. In other words, the torque limiter is used at the time of regular rotation transport. Thus, when a large transport resistance is caused downstream, the resist roller cannot press the medium by a torque larger than a set torque of the torque limiter. Therefore, when a jam of the medium is caused in the periphery of the recording unit, the medium can be prevented from being forcefully pressed, being deformed three-dimensionally, and contacting with the recording unit to cause damage.

Similarly, the torque limiter limits a force of pressing the medium from behind, and hence a risk of disturbing a transport state of the medium can be suppressed.

A medium processing apparatus according to a sixteenth aspect of the present disclosure includes the skew correction device of the ninth mode, a driving source configured to drive the resist roller, an upstream transport unit configured to transport the medium to the skew correction device, a downstream transport unit configured to transport the medium after skew correction performed by the skew correction device, and a processing unit configured to execute processing on the medium transported by the downstream transport unit.

According to the present mode, in the device that executes processing such as printing for the medium, effects based on the skew correction device of the ninth mode can be exerted. At the same time, skew correction can appropriately be performed, and accuracy of the processing can be improved.

According to a seventeenth mode of the present disclosure, the medium processing apparatus of the sixteenth mode further includes a control unit configured to control the skew correction device, wherein the control unit is configured to select between stoppage skew correction for correcting skew of the medium in a state in which the stoppage clutch stops the resist roller and reverse-rotation skew correction for correcting skew of the medium in a state in which the reverse-rotation clutch reversely rotates the resist roller.

According to the present mode, the control unit can select between the stoppage skew correction and the reverse-rotation skew correction. With this, an appropriate skew correction method is selected in accordance with a type of the medium, contents of the processing, a processing speed, or the like. Thus, skew correction can be performed more effectively. In particular, with a simple configuration, the plurality of skew correction methods can be selected and performed.

According to an eighteenth mode of the present disclosure, in the medium processing apparatus of the seventeenth mode, the control unit is configured to, when performing the reverse-rotation skew correction, select between first reverse-rotation skew correction for correcting skew by causing a leading edge of the medium to abut against a resist roller in a state in which the resist roller is reversely rotated and second reverse-rotation skew correction for correcting skew of the medium by reversely rotating the resist roller after the leading edge of the medium passes through the resist roller.

According to the present mode, when the reverse-rotation skew correction is performed, the control unit can select between the first reverse-rotation skew correction and the second reverse-rotation skew correction. With this, an appropriate skew correction method is selected in accordance with a type of the medium, contents of the processing, a processing speed, or the like. Thus, skew correction can be performed more effectively. In particular, with a simple configuration, the plurality of skew correction methods can be selected and performed.

According to a nineteenth mode of the present disclosure, in the medium processing apparatus of the sixteenth mode, the processing unit is a recording unit configured to perform recording on the medium, and the recording unit performs recording on the medium after skew correction performed by the skew correction device.

According to the present mode, skew correction can appropriately be performed before the medium to be subjected to recording is transported to the recording unit, and hence recording accuracy can be improved.

Further, the skew correction device of the sixth mode is used. In other words, the torque limiter is used at the time of regular rotation transport. Thus, when a large transport resistance is caused downstream, the resist roller cannot perform pressing by a torque larger than a set torque of the torque limiter. Therefore, when a jam of the medium is caused in the periphery of the recording unit, the medium can be prevented from being forcefully pressed, being deformed three-dimensionally, and contacting with the recording unit to cause damage.

Similarly, the torque limiter limits a force of pressing the medium from behind, and hence a risk of disturbing a transport state of the medium can be suppressed.

A skew correction device according to a twentieth mode of the present disclosure is configured to transport a medium through regular rotation of a resist roller and correct skew of the medium through reverse rotation or stoppage of the resist roller. The skew correction device includes the resist roller, a driven roller configured to transport the medium by nipping the medium together with the resist roller and correct skew of the medium, and a driving force transmission unit configured to transmit a driving force from a driving source to the resist roller, wherein the driving force transmission unit includes a first clutch being in a coupling state of transmitting a driving force at the time of regular rotation of the resist roller and being in a cut-off state of not transmitting a driving force at the time of reverse rotation of the resist roller, a second clutch being in a cut-off state of not transmitting a driving force at the time of regular rotation of the resist roller and being in a coupling state of transmitting a driving force at the time of reverse rotation of the resist roller, an idle gear being engaged with the second clutch and being configured to transmit a driving force from the driving source to the second clutch, a first toothed gear being engaged with the first clutch and being configured to transmit a driving force from the driving source to the first clutch, and a second toothed gear being engaged with the idle gear and being configured to transmit a driving force from the driving source to the idle gear, the first clutch and the second clutch are coaxially provided, the first toothed gear and the second toothed gear are coaxially provided, one of the first toothed gear and the second toothed gear receives a driving force from the driving source, and another one of the first toothed gear and the second toothed gear is integrally rotated with the one thereof.

Here, the expression "correct skew" in "correct skew of the medium" indicates that skew of the medium is not required to be eliminated completely.

According to the present mode, the driving force transmission unit transmits a driving force from the driving source to the resist roller via the first clutch, the second clutch, the idle gear, the first toothed gear, and the second toothed gear. With this, when the resist roller is regularly rotated, the first clutch is in the cut-off state. Thus, a load applied from the resist roller at the time of regular rotation transport is suppressed. Further, as compared to a configuration in which a motor is regularly/reversely rotated, a time period required for acceleration of the motor is not required. Thus, a throughput can be improved.

Further, the first clutch and the second clutch are coaxially provided. Thus, driving force transmission loss can be suppressed, and size reduction can be achieved. Further, the first toothed gear and the second toothed gear are coaxially provided. Thus, driving force transmission loss can be suppressed, and size reduction can be achieved.

A medium processing apparatus according to a twenty-first mode of the present disclosure includes the skew correction device of the twentieth mode, a driving source configured to drive the resist roller, an upstream transport unit configured to transport the medium to the skew correction device, a downstream transport unit configured to transport the medium after skew correction performed by the skew correction device, and a processing unit configured to execute processing on the medium transported by the downstream transport unit.

According to the present mode, in the device that executes processing such as printing for the medium, effects based on the skew correction device of the ninth mode can be exerted. At the same time, skew correction can appropriately be performed, and accuracy of the processing can be improved.

According to a twenty-second mode of the present disclosure, the medium processing apparatus of the twenty-first mode further includes a control unit configured to control the skew correction device, wherein the control unit is configured to select between first reverse-rotation skew correction for correcting skew by causing a leading edge of the medium to abut against a resist roller in a state in which the resist roller is reversely rotated, and second reverse-rotation skew correction for correcting skew of the medium by reversely rotating the resist roller after the leading edge of the medium passes through the resist roller.

According to the present mode, the control unit can select between the first reverse-rotation skew correction and the second reverse-rotation skew correction. With this, an appropriate skew correction method is selected in accordance with a type of the medium, contents of the processing, a processing speed, or the like. Thus, skew correction can be performed more effectively. In particular, with a simple configuration, the plurality of skew correction methods can be selected and performed.

EXEMPLARY EMBODIMENTS

A skew correction device and a medium processing apparatus including the skew correction device according to each exemplary embodiment of the present disclosure are specifically described below with reference to FIG. 1 to FIG. 6.

In the following description, three axes orthogonal to one another are assumed to be an X-axis, a Y-axis, and a Z-axis, respectively, as illustrated in the respective drawings. A Z-axis direction corresponds to a vertical direction, that is, a direction in which a gravitational force acts. An X-axis direction and a Y-axis direction correspond to a horizontal direction. In each of the drawings, directions indicated with arrows of the three axes (X, Y, and Z) indicate + directions of the respective axes, and directions opposite thereto indicate − directions.

A medium processing apparatus 1 of the present exemplary embodiment is an ink-jet type printer that performs printing by ejecting an ink being a liquid onto a medium such as paper. Note that, as a matter of course, the apparatus is not limited to an ink-jet type printer.

As illustrated in FIG. 1, in the medium processing apparatus 1 of the present exemplary embodiment, a medium P is picked up by a pick-up roller 4 from a medium cassette 2 positioned in a lower part of the apparatus, is separated one by one by a separation roller pair 6, and is fed to a transport path 10 in a feeding path 8. The medium P is transported downstream in a transport direction in the transport path 10, during which a recording unit 12 arranged along the transport path 10 performs recording thereon. The medium P after recording is further transported downstream in the transport path 10, and is discharged to a first discharge tray 14. In the present exemplary embodiment, a second discharge tray 16 is positioned above the first discharge tray 14. A flap 38 is also configured to discharge the medium P to the second discharge tray 16 by changing the transport direction.

In the present exemplary embodiment, the recording unit 12 is configured as a line head. A transport belt 18 is provided to face the recording unit 12 as a platen for supporting the medium P.

A transport roller pair 3, a transport roller pair 5, a transport roller pair 7, and a transport roller pair 9 are arranged at positions in the transport path 10 upstream of the recording unit 12 in the stated order from upstream to downstream in the transport direction. The medium P receives a transport force from each of the transport roller pairs 3, 5, 7, and 9, and is transported downstream to the position of the recording unit 12.

In the following description, unless otherwise noted, the "roller pair" includes a driving roller that is driven by transmitting a driving force from a driving source 29 such as a motor and a driven roller that is driven to be rotated in contact with the driving roller.

A transport roller pair 11, a transport roller pair 13, and a transport roller pair 15 are arranged at positions in the transport path 10 downstream of the recording unit 12 in the stated order toward the first discharge tray 14. The medium P is transported by receiving a transport force from each of the transport roller pairs 11, 13, and 15, and is discharged to the first discharge tray 14.

Further, a transport roller pair 17 and a transport roller pair 19 are further arranged in the stated order in the transport path 10 toward the second discharge tray 16. When the medium P is discharged to the second tray 16, the medium P is transported by receiving a transport force from each of the transport roller pairs 11, 13, 17, and 19, and is discharged to the second discharge tray 16.

A switch-back path 20 is coupled at a position between the transport roller pair 11 and the transport roller pair 13 in the transport path 10. When recording is performed on both front and back surfaces of the medium P, a flap 22 changes the transport direction of the medium P, which is transported in the transport path 10, to the switch-back path 20 between the transport roller pair 11 and the transport roller pair 13. The medium P fed to the switch-back path 20 receives a transport force from a transport roller pair 21 and a transport roller pair 23, and is transported downstream. A driving source 31 different from the driving source 29 transmits a driving force to the transport roller pair 21 and the transport roller pair 23.

The switch-back path 20 is coupled to a reverse rotation path 24 at a position upstream of the transport roller pair 21. A trailing edge E of the medium P transported downstream in the switch-back path 20. When the trailing edge E of the medium P passes through a coupling unit 26 with the reverse rotation path 24, the driving source 31 reversely rotates the transport roller pair 21 and the transport roller pair 23. With this, the trailing edge E of the medium P enters the reverse rotation path 24 as a leading edge. The coupling unit 26 is configured so that the leading edge of the medium P that is returned upstream from the switch-back path 20 enters the reverse rotation path 24.

The reverse rotation path 24 joins the transport path at a position between the transport roller pair 5 and the transport roller pair 7. A transport roller pair 25 and a transport roller pair 27 are arranged in the stated order to downstream in the reverse rotation path 24. The medium P fed to the reverse rotation path 24 receives a transport force from the transport roller pair 25 and the transport roller pair 27, is transported downstream, and is fed to the transport path 10 that joins the path right before the transport roller pair 7. A driving force is transmitted from the driving source 29 to the transport roller pair 25 and the transport roller pair 27.

The recording unit 12 performs recording on the back surface of the medium P fed from the reverse rotation path 24 to the transport path 10. Then, the medium P is transported to the first discharge tray 14 or the second discharge tray 16, and is finally discharged.

In the present exemplary embodiment, it is configured that the medium P can also be fed from a feeding tray 28 for recording. The medium P on the feeding tray 28 is fed downstream by a pair including a feeding roller 30 being a driving roller and a separation roller 32 being a retard roller, passes through a feeding path 34, and is fed to the transport path 10. The feeding path 34 joins the transport path 10 at a position between the transport roller pair 5 and the transport roller pair 7. A driving force is transmitted from the driving source 29 to feeding roller 30.

Further, in the present exemplary embodiment, another medium cassette, which is omitted in illustration, is provided below the medium cassette 2. It is configured that the medium P on the other medium cassette passes through a feeding path 36, and is fed to the transport path 10.

Skew Correction Device

The medium processing apparatus 1 of the present exemplary embodiment includes a skew correction device 41 that corrects skew of the medium P. The skew correction device 41 prevents the medium P to be transported to the recording unit 12 from being fed in the transport direction in a skewed posture. In other words, when the medium P is skewed, the skew correction device 41 corrects skew, and feds the medium P in an original posture to the recording unit. Here, in the present specification, the expression "correct skew" for correcting skew of the medium P indicates that skew of the medium P being transported is not required to be eliminated in a strict sense.

The skew correction device 41 of the present exemplary embodiment is configured by utilizing the transport roller pair 9 positioned right before the recording unit 12.

Basic Configuration of Skew Correction Device

First, a basic configuration of the skew correction device 41 according to the present disclosure is described with reference to FIG. 1 and FIG. 2. Then, a specific configuration of the skew correction device 41 is described while providing four exemplary embodiments.

The skew correction device 41 transports the medium P through regular rotation of a resist roller 43, and corrects skew of the medium through reverse rotation or stoppage of the resist roller 43. The resist roller 43 is a driving roller driven by a driving force from the driving source 29. A driven roller 45 nips the medium P together with the resist roller 43, transports the medium P through regular rotation, and corrects skew of the medium P through reverse rotation or stoppage. A driving force from the driving source 29 is transmitted to the resist roller 43 by a driving force transmission unit 47 (FIG. 2). The driving source 29 is configured to receive a control signal from a control unit 49 and execute respective driving states including regular rotation, reverse rotation, and stoppage, based on the control signal.

Skew Correction Device of First Exemplary Embodiment

In a first exemplary embodiment, the driving force transmission unit 47 transmits a driving force from the driving source 29 via a torque limiter 51, and regularly rotates the resist roller 43. Moreover, a clutch 53 is provided. The clutch 53 performs switching between a state of regularly rotating the resist roller 43 and a state of reversely rotating the resist roller 43. In the first exemplary embodiment, the clutch 53 is a stoppage clutch capable of stopping the resist roller 43.

The torque limiter 51 is meshed with a toothed gear 40. The driving source 29 and the toothed gear 40 are dynamically coupled to each other via a driving force transmission mechanism 42 dedicated to the torque limiter. In the present exemplary embodiment, the torque limiter 51 is configured to transmit, via the toothed gear 40, a driving force for rotation in the regular rotation direction. Without exceeding a set torque, the torque limiter 51 is in a state of being capable of transmitting a torque, that is, a state of being capable of transmitting a driving force. In contrast, when a set torque is exceeded, a certain mechanism causes a slip state in which torque transmission is blocked, that is, a driving force is not transmitted.

Further, in the present exemplary embodiment, the clutch 53 being a stoppage clutch includes a regulation unit 59 that is engaged with, that is, coupled to the clutch 53 and regulates an stops rotation of the clutch 53. The regulation unit 59 is fixed to a fixing portion, which is omitted in illustration. The clutch 53 is configured to stop rotation of the clutch 53 in the coupling state with the regulation unit 59 at the time of receiving the control signal from the control unit 49 and to rotate in the non-coupling state with the regulation unit 59. When rotation of the clutch 53 is stopped, rotation of the resist roller 43 is stopped. In other words, the clutch 53 is a stoppage clutch. With this, skew of the medium P can be corrected in a state in which the resist roller 43 is stopped.

Note that the regulation unit 59 is only required to be coupled to the clutch 53 and stop rotation of the clutch 53, and a method of providing the regulation unit 59 is not limited to a specific structure.

Figure 2:
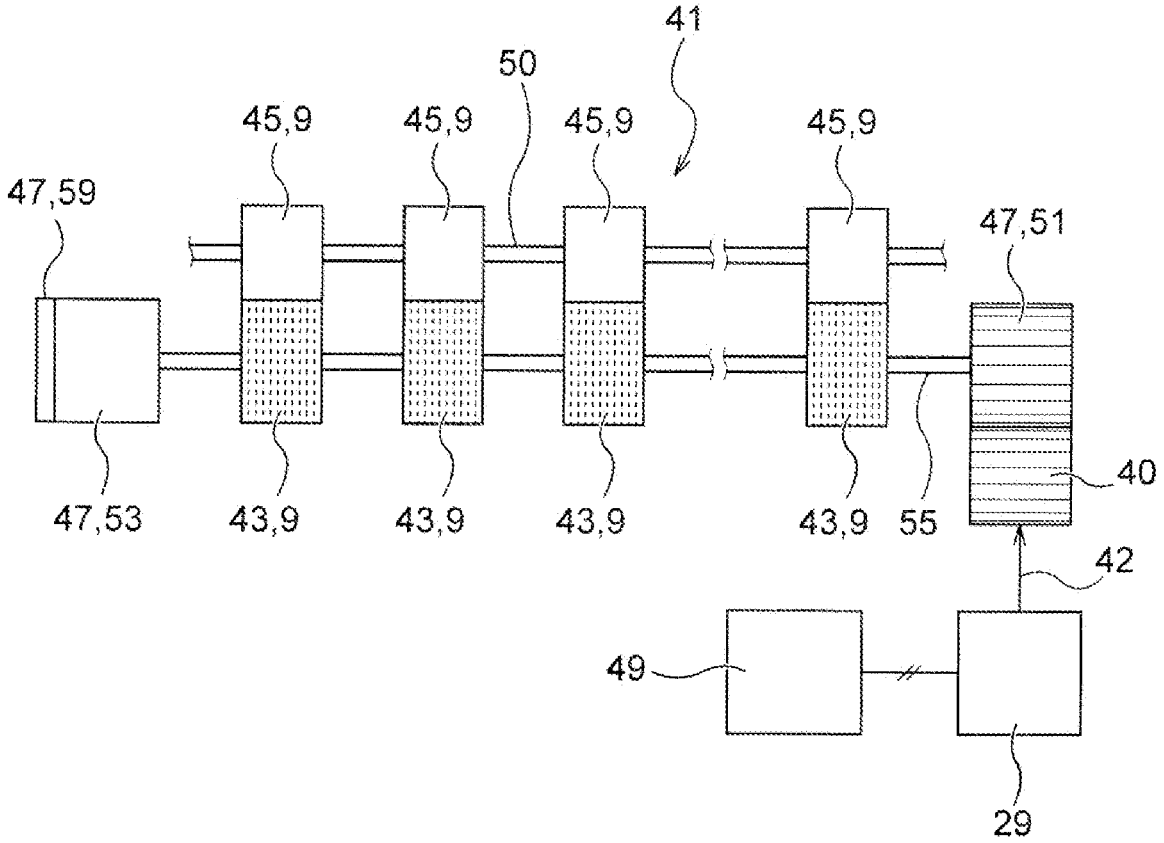
FIG. 2 is a plan view of a skew correction device according to the first exemplary embodiment.

As illustrated in FIG. 2, in the present exemplary embodiment, the resist roller 43 is configured to be rotated about a roller shaft 55 integrally with the roller shaft 55. The driven roller 45 is also rotatable about the roller shaft A torque limiter 43 and the clutch 53 are provided to the roller shaft 55. The torque limiter 43 is arranged at one end of the roller shaft 55, and the clutch 53 is arranged at the other end of the roller shaft 55.

Note that the torque limiter 43 and the clutch 53 are not limited to a structure of being provided to the roller shaft that is coaxial, and may be provided to different shafts as long as the functions thereof can be exerted.

Figure 3:
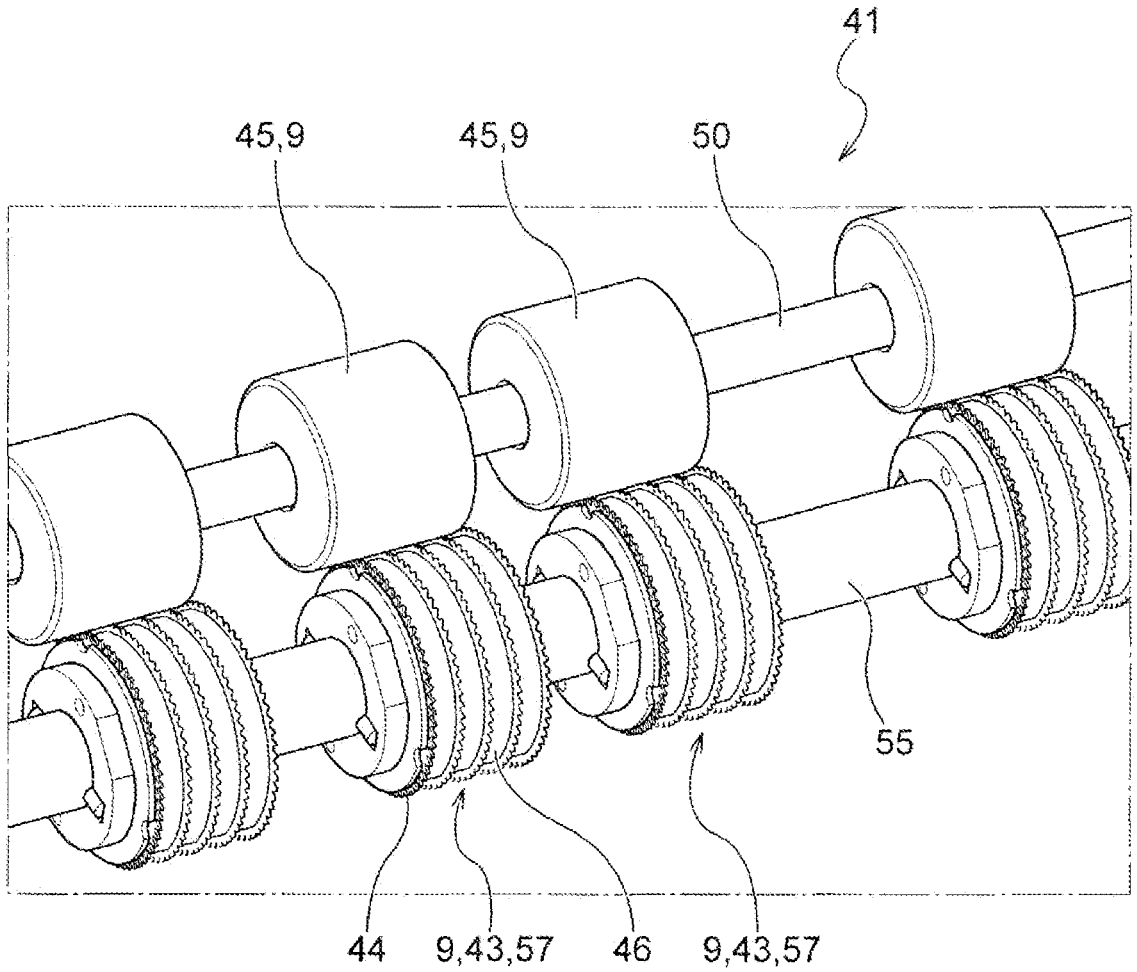
FIG. 3 is a partially enlarged perspective view of the skew correction device according to the first exemplary embodiment.

In the present exemplary embodiment, as illustrated in FIG. 3, the resist roller 43 is formed of a toothed roller 57. The toothed roller 57 indicates a roller that has a plurality of tooth, in other words, protrusions 44 on an outer surface 46. The portions corresponding to the protrusions 44 contact with the medium P, and thus establishes a point contact state in a contact area with the medium P. Note that, as a matter of course, the resist roller 43 is not limited to the toothed roller 57.

As illustrated in FIG. 1, the medium processing apparatus 1 including the skew correction device 41 of the first exemplary embodiment the driving source 29 that drives the resist roller 43, an upstream transport unit 61 that transports the medium P in the skew correction device 41, a downstream transport unit 63 that transports the medium P after skew correction performed by the skew correction device 41, and a processing unit 65 that executes processing on the medium P transported by the downstream transport unit 63.

The upstream transport unit 61 includes a section upstream of the recording unit 12 in the transport path 10, and the transport roller pair 3, the transport roller pair 5, the transport roller pair 7, and the transport roller pair 9 that are arranged in the section. The downstream transport unit 63 includes a section downstream of the recording unit 12 in the transport path 10, and the transport roller pair 11, the transport roller pair 13, the transport roller pair 15, the transport roller pair 17, and the transport roller pair 19 that are arranged in the section.

As described above, the processing unit 65 is the recording unit 12 that performs recording on the medium P. The recording unit 12 performs recording on the medium P after skew correction performed by the skew correction device 41.

Note that the processing unit 65 is not limited to the recording unit 12, and examples thereof include a reading unit and a post-processing unit that executes punching processing, staple processing, saddle stitching processing, folding processing, shift discharge processing, bar-stacking processing, or the like.

Skew Correction of Skew Correction Device of First Exemplary Embodiment

The skew correction device 41 of the first exemplary embodiment corrects skew of the medium P with the control unit 49 in the following manner in a state in which the resist roller 43 is stopped.

(1) When the leading edge of the medium P transported through the upstream transport unit 61 arrives at the position right before the transport roller pair 9, a sensor, which is omitted in illustration, detects the leading edge. In response to the detection signal, the control unit 49 transmits the control signal to the clutch 53. Then, the clutch 53 is in the coupling state with the regulation unit 59. With this, the regulation unit 59 regulates to stop rotation of the clutch 53, and the resist roller 43 is changed from the regular rotation state to the stoppage state. At the same time, rotation of the driven roller 45 is stopped. In this state, the torque limiter 51 is in a state of exceeding a set torque, and hence the portion of the torque limiter 51 that is positioned on the toothed gear 40 side slips with respect to the portion thereof that is positioned on the roller shaft 55 side.

(2) After that, the leading edge of the medium P being transported abuts against the nipping position between the resist roller 43 and the driven roller 45, and movement of the leading edge in the transport direction is stopped. In this state, the medium P receives a transport force from the transport roller pair 7 and the like positioned upstream, and is bent to a small degree. Then, skew correction progresses.

(3) Moreover, after a predetermined time period that is set in advance for skew correction elapses, the control unit 49 transmits the control signal to the clutch 53, and the coupling state between the clutch 53 and the regulation unit 59 is canceled. Then, the resist roller 43 is switched from the stoppage state to the rotatable state. With this, the torque limiter 51 is in the state of not exceeding a set torque, and is changed from the slip state to the regular rotation state capable of transmitting a driving force. The resist roller 43 starts regular rotation, and transports the medium P to the recording unit 12. The recording unit 12 performs recording on the medium P after skew correction.

Description of Effects of First Exemplary Embodiment (1) In the first exemplary embodiment, the skew correction device 41 includes the driving force transmission unit 47 that transmits a driving force from the driving source 29 via the torque limiter 51 and regularly rotates the resist roller 43, and the clutch 53 that performs switching between the state of regularly rotating the resist roller 43 and the state of stopping the resist roller 43. The clutch 53 functions as a stoppage clutch.

With this, the clutch 53 is in the state capable of regularly rotating the resist roller 43, and thus the resist roller 43 is regularly rotated. In other words, a driving force in the regular rotation direction is transmitted to the resist roller 43 via the torque limiter 51, and thus the resist roller 43 is regularly rotated immediately.

When the resist roller 43 is reversely rotated or stopped so as to perform the skew correction, the clutch 53 is switched to a state of reversely rotating or stopping the resist roller 43. In other words, the torque limiter 51 exceeds a set torque, and thus is in a slip state. With this, transmission of a driving force in the regular rotation direction is blocked, and the reverse rotation or stoppage is achieved. With this, a load applied from the resist roller 43 at the time of regular rotation transport can be suppressed. Further, the clutch 53 and the torque limiter 51 can be prevented from being worn, and durability is improved.

Further, a cost can be reduced as compared to a configuration in which a plurality of clutches are used as the driving force transmission unit 47 in place of the torque limiter 51. Further, the torque limiter 51 always achieves a state in which backlash is suppressed. Thus, degradation of correction accuracy, which is caused by generation of noise due to backlash at the time of switching the rotation directions and movement of the resist roller 43 due to backlash at the time of correcting skew of the medium P (hereinafter, also referred to as "skew correction"), can be suppressed.

Further, the clutch 53 has a time lag from transmission of an instruction for coupling or cutting-off to actual completion of coupling or cutting-off. Thus, in a configuration in which a plurality of clutches are used in place of the torque limiter 51, another clutch cannot be controlled until one of the clutches completes coupling or cutting-off.

However, in the present mode, the one of those is the torque limiter 51. With this, the rotation direction is naturally switched due to a relationship between a load applied from the clutch 53 and a set torque of the torque limiter 51. In other words, a time lag generated at the time of switching the rotation directions can be suppressed. In other words, a throughput can be improved.

Further, in a configuration in which a motor is regularly rotated or reversely rotated, a time period required for acceleration of the motor needs to be considered at the time of control. However, in the present exemplary embodiment, here is no need to consider a time period required for acceleration of the motor, and hence a throughput can be improved.

(2) Further, according to the present exemplary embodiment, the resist roller 43 is rotatable about the roller shaft 55 integrally with the roller shaft 55, and the torque limiter 51 and the clutch 53 are provided to the roller shaft With this, the torque limiter 51 and the clutch 53 are provided to the roller shaft 55. Thus, driving force transmission loss can be suppressed, and size reduction can be achieved.

(3) Further, in the present exemplary embodiment, the resist roller 43 is the toothed roller 57. In general, when the resist roller 43 is the toothed roller 57, there arises a problem in that the resist roller has an easily-rotated structure at the time of entry of the medium P as compared to a resist roller without protrusions.

However, according to the present exemplary embodiment, the resist roller 43 is in a state in which the torque limiter 51 always suppresses backlash. With this, skew correction can effectively be performed without being affected by the problem.

Further, in a configuration in which the medium P is subjected to skew correction again by the resist roller 43 for duplex printing, the toothed roller 57 is used as the resist roller 43 so as to suppress a transfer.

(4) Further, according to the present exemplary embodiment, the clutch 53 is engaged with the regulation unit 59, and thus rotation of the clutch is regulated and stopped. When rotation of the clutch 53 is stopped, rotation of the resist roller 43 is also stopped. With this, skew can be corrected in a state in which the resist roller 43 is stopped.

Further, the clutch 53 applies a brake to stop the resist roller 43. With this, as compared to a configuration without the clutch 53 or a configuration in which the torque limiter 51 stops the resist roller 43, a torque for suppressing rotation of the resist roller 43 is higher. With this, the medium P can be prevented from passing through, and hence accuracy of skew correction is improved.

(5) Further, according to the present exemplary embodiment, in the medium processing apparatus 1 that executes processing such as recording for the medium P, the above-mentioned effects based on the skew correction device 41 can be exerted. At the same time, skew correction can appropriately be performed, and accuracy of the processing can be improved.

(6) Further, according to the present exemplary embodiment, skew correction can appropriately be performed before the medium P to be subjected to recording is transported to the recording unit 12, and hence recording accuracy can be improved.

Further, the skew correction device 41 described above is used. In other words, the torque limiter 51 is used at the time of regular rotation transport. Thus, when a large transport resistance is caused downstream, the resist roller 43 cannot press the medium P by a torque larger than a set torque of the torque limiter 51. Therefore, it is possible to suppress a problem that, when a jam of the medium P is caused in the periphery of the recording unit 12, the medium P is forcefully pressed, is deformed three-dimensionally, and contacts with the recording unit 12 to cause damage.

Similarly, the torque limiter 51 limits a force of pressing the medium P from behind, and hence a risk of disturbing a transport state of the medium P can be suppressed. In particular, on the transport belt 18, a risk of disturbing a transport state of the medium P due to a transport force of the resist roller 43 can be suppressed.

Note that the effects can similarly be exerted even when the medium processing apparatus 1 includes a reading unit, a post-processing unit, or the like in place of the recording unit.

Second Exemplary Embodiment

The skew correction device 41 according to a second exemplary embodiment and the medium processing apparatus 1 including the skew correction device 41 are specifically described below with reference to FIG. 1 and FIG. 4. Parts similar to those of the first exemplary embodiment are denoted with the same reference symbols, and the configurations and corresponding effects thereof are omitted in description.

In the skew correction device 41 of the second exemplary embodiment, a reverse-rotation clutch 69 that reverses rotation of the resist roller 43 is used as a clutch, in place of the stoppage clutch 53 of the first exemplary embodiment. In other words, skew of the medium P can be corrected in a state in which the resist roller 43 is reversely rotated.

The reverse-rotation clutch 69 is mounted to the roller shaft 55 at a position adjacent to the torque limiter 51. In other words, the torque limiter 51 and the reverse-rotation clutch 69 are provided on the same side with respect to the center of the roller shaft 55.

In the present exemplary embodiment, a driving force transmission unit 67 includes an idle gear 71 that transmits a driving force from the driving source 29 to the reverse-rotation clutch 69. Note that, although FIG. 4 illustrates one idle gear 71, the number of idle gears is not limited thereto. A plurality of idle gears may be provided.

In the present exemplary embodiment, the driving force transmission unit 67 further includes a first toothed gear 73 that is engaged with the torque limiter 51 and transmits a driving force from the driving source 29 to the torque limiter 51, and a second toothed gear 75 that is engaged with the idle gear 71 and transmits a driving force from the driving source 29 to the idle gear 71. Here, the second toothed gear 75 is formed to have a diameter smaller than that of the first toothed gear 73.

The first toothed gear 73 and the second toothed gear are provided to a shaft 48 that is coaxial thereto, and both the gears are integrally rotated via the shaft 48. In this case, the first toothed gear 73 receives a driving force from the driving source 29, and the second toothed gear 75 is rotated integrally with the first toothed gear 73. Similarly to the first exemplary embodiment, the first toothed gear 73 always transmits, to the torque limiter 51, a driving force of driving the resist roller 43 in the regular rotation direction. A driving force of driving the resist roller 43 in the reverse rotation direction is always transmitted to the reverse-rotation clutch 69 via the second toothed gear 75 and the idle gear 71.

The reverse-rotation clutch 69 is configured to be in a cut-off state of not transmitting a driving force at the time of regular rotation of the resist roller 43 and in a reverse rotation coupling state of transmitting a driving force at the time of reverse rotation of the resist roller 43.

Specifically, at the time of regular rotation of the resist roller 43, the reverse-rotation clutch 69 receives the control signal from the control unit 49, and is in a dynamically non-coupling state with the roller shaft 55. With this, a driving force of the driving source 29 is transmitted to the resist roller 43 via the torque limiter 51, and thus the resist roller 43 is regularly rotated.

At the time of reverse rotation of the resist roller 43, the reverse-rotation clutch 69 receives the control signal from the control unit 49, and is in a dynamically coupling state with the roller shaft 55. With this, a driving force of the driving source 29 is transmitted to the resist roller 43 via the reverse-rotation clutch 69, and thus the resist roller 43 is reversely rotated. In this state, the torque limiter 51 exceeds a set torque, and thus is in the slip state.

The medium processing apparatus 1 according to the second exemplary embodiment is basically similar to the medium processing apparatus 1 according to the first exemplary embodiment. Configurations different from those of the first exemplary embodiment are described below.

In the medium processing apparatus 1 according to the second exemplary embodiment, the control unit 49 that controls the skew correction device 41 has the following control mode.

In the control mode, first reverse-rotation skew correction can be performed. In the first reverse-rotation skew correction, the leading edge of the medium P is caused to abut against the resist roller 43 at the nipping position during reverse rotation of the resist roller 43, and then skew correction is performed in that state. In the control mode, second reverse-rotation skew correction can further be performed. In the second reverse-rotation skew correction, the resist roller 43 is reversely rotated after the leading edge of the medium P passes through the nipping position of the resist roller 43, and then the leading edge of the medium P is returned upstream of the nipping position. In this state, skew of the medium P is corrected. Any one of the first reverse-rotation skew correction and the second reverse-rotation skew correction is selected and performed.

Selection between the first reverse-rotation skew correction and the second reverse-rotation skew correction may be easily performed by a user through an operation panel or the like, which is omitted in illustration. Alternatively, the control unit may be configured to perform selection, based on input information from a user or information relating to a printing job. Note that a size, a type (based on rigidity, a basis weight, a thickness, or the like), a transport speed (a printing speed, a reading speed, a processing speed, or the like), or the like of the medium P can be utilized as information for the selection.

In the present exemplary embodiment, the first reverse-rotation skew correction, that is, an operation of causing the leading edge of the medium P to abut against the resist roller 43 at the nipping position during reverse rotation of the resist roller 43 and correcting skew is performed in such a manner that a sensor, which is omitted in illustration, detects a position of the medium and transmits the detection signal to the control unit 49.

In the present exemplary embodiment, the second reverse-rotation skew correction, that is, an operation of reversely rotating the resist roller 43 after the leading edge of the medium P passing through the nipping position of the resist roller 43 and correcting skew of the medium P is also performed in such a manner that a sensor, which is omitted in illustration, detects a position of the medium and transmits the detection signal to the control unit 49.

Skew Correction of Skew Correction Device of Second Exemplary Embodiment

The skew correction device 41 of the second exemplary embodiment corrects skew of the medium P with the control unit 49 in the following manner in a state in which the resist roller 43 is regularly rotated. In this state, a user selects any one of the first reverse-rotation skew correction and the second reverse-rotation skew correction in advance.

(1) Case in which First Reverse-Rotation Skew Correction is Selected (1-1) When the leading edge of the medium P transported through the upstream transport unit 61 arrives at the position right before the transport roller pair 9, a sensor, which is omitted in illustration, detects the leading edge. In response to the detection signal, the control unit 49 transmits the control signal to the reverse-rotation clutch 69. With this, the reverse-rotation clutch 69 is switched to the dynamically coupling state with the roller shaft 55, and reversely rotates the resist roller 43. In this state, the torque limiter 51 exceeds a set torque, and thus is in the slip state. Moreover, the leading edge of the medium P is caused to abut against the resist roller 43 at the nipping position during reverse rotation of the resist roller 43.

(1-2) After that, the leading edge of the medium P being transported abuts against the nipping position between the resist roller 43 and the driven roller 45 that are reversely rotated, and movement of the leading edge in the transport direction is stopped. In this state, the medium P receives a transport force from the transport roller pair 7 and the like positioned upstream, and is bent to a small degree. Then, skew correction progresses.

(1-3) Moreover, after a predetermined time period that is set in advance for skew correction elapses, the control unit 49 transmits the control signal to the reverse-rotation clutch 69, and the reverse-rotation clutch 69 is switched to the dynamically non-coupling state with the roller shaft 55. With this, the torque limiter 51 is in the state of not exceeding a set torque, and is changed from the slip state to a state of being capable of transmitting a driving force. In other words, regular rotation of the resist roller 43 is started again, and the medium P is transported to the recording unit 12. The recording unit 12 performs recording on the medium P after skew correction.

(2) Case in which Second Reverse-Rotation Skew Correction is Selected (2-1) In a state in which a sensor, which is omitted in illustration, detects the leading edge of the medium P being transported through the upstream transport unit 61, the leading edge of the medium P arrives at the nipping position of the resist roller 43 arrives at the nipping position of the resist roller 43 being regularly rotated, passes therethrough, and is further fed by a predetermined amount in the transport direction. Then, the control unit 49 transmits the control signal to the reverse-rotation clutch 69. In response to the control signal, the reverse-rotation clutch 69 is in the dynamically coupling state with the roller shaft 55, and the resist roller 43 is changed from the regular rotation state to the reverse rotation state. In this state, the torque limiter 51 exceeds a set torque, and thus is in the slip state.

(2-2) The resist roller 43 is reversely rotated, and thus the leading edge of the medium P is returned upstream of the nipping position. In this state, the medium P is in a state in which a part thereof positioned upstream of the nipping position receives a transport force in the regular rotation direction from the transport roller pair 7 and the like and a part thereof positioned downstream of the nipping position receives a transport force in the reverse rotation direction from the reverse-rotation clutch 69. Thus, skew correction progresses effectively.

(2-3) Moreover, after the entire leading edge of the medium P is returned upstream of the nipping position, the control unit 49 transmits the control signal to the reverse-rotation clutch 69. Then, the reverse-rotation clutch 69 is switched to the dynamically non-coupling state with the roller shaft 55. With this, the torque limiter 51 is in the state of not exceeding a set torque, and is changed from the slip state to a state of being capable of transmitting a driving force. In other words, regular rotation of the resist roller 43 is started again, and the medium P is transported to the recording unit 12. The recording unit 12 performs recording on the medium P after skew correction.

Description of Effects of Second Exemplary Embodiment (1) In the second exemplary embodiment, the skew correction device 41 includes the driving force transmission unit 67 that transmits a driving force from the driving source 29 via the torque limiter 51 and regularly rotates the resist roller 43, and the reverse-rotation clutch 69 that performs switching between the state of regularly rotating the resist roller 43 and the state of reversely rotating the resist roller 43. The torque limiter 51 and the reverse-rotation clutch 69 are provided, and thus effects similar to the effects based on the torque limiter 51 and the clutch 53 of the first exemplary embodiment can be exerted.

(2) Further, according to the present exemplary embodiment, the idle gear 71 transmits a driving force so that the reverse-rotation clutch 69 reversely rotates the resist roller 43. With this, the torque limiter 51 exceeds a set torque, and thus is in the slip state. With this, transmission of a driving force in the regular rotation direction is blocked, and skew correction can be performed in a state in which the reverse-rotation clutch 69 reversely rotates the resist roller 43.

(3) Further, according to the present exemplary embodiment, the first toothed gear 73 and the second toothed gear 75 are coaxially provided. Thus, driving force transmission loss can be suppressed, and size reduction can be achieved.

Further, the second toothed gear 75 has a diameter smaller than that of the first toothed gear 73. Thus, a speed of reverse rotation can be reduced without changing a rotation speed of the driving source 29.

(4) Further, according to the present exemplary embodiment, in the medium processing apparatus 1 that executes processing such as recording for the medium P, the above-mentioned effects based on the skew correction device 41 can be exerted. At the same time, skew correction can appropriately be performed, and accuracy of the processing can be improved.

(5) Further, according to the present exemplary embodiment, the control unit 49 can select between the first reverse-rotation skew correction and the second reverse-rotation skew correction. With this, an appropriate skew correction method is selected in accordance with a type of the medium P, contents of the processing, a processing speed, or the like. Thus, skew correction can be performed more effectively. In particular, with a simple configuration, the plurality of skew correction methods can be selected and performed.

(6) Further, according to the present exemplary embodiment, skew correction can appropriately be performed before the medium P to be subjected to recording is transported to the recording unit 12, and hence recording accuracy can be improved.

Further, the skew correction device 41 described above is used. In other words, the torque limiter is used at the time of regular rotation transport. Thus, when a large transport resistance is caused downstream, the resist roller cannot press the medium P by a torque larger than a set torque of the torque limiter. Therefore, when a jam of the medium P is caused in the periphery of the recording unit 12, the medium P can be prevented from being forcefully pressed, being deformed three-dimensionally, and contacting with the recording unit 12 to cause damage.

Similarly, the torque limiter 51 limits a force of pressing the medium P from behind, and hence a risk of disturbing a transport state of the medium P can be suppressed. In particular, on the transport belt 18, a risk of disturbing a transport state of the medium P due to a transport force of the resist roller 43 can be suppressed.

Note that the effects can similarly be exerted even when the medium processing apparatus 1 includes a reading unit, a post-processing unit, or the like in place of the recording unit.

Third Exemplary Embodiment

Figure 5:
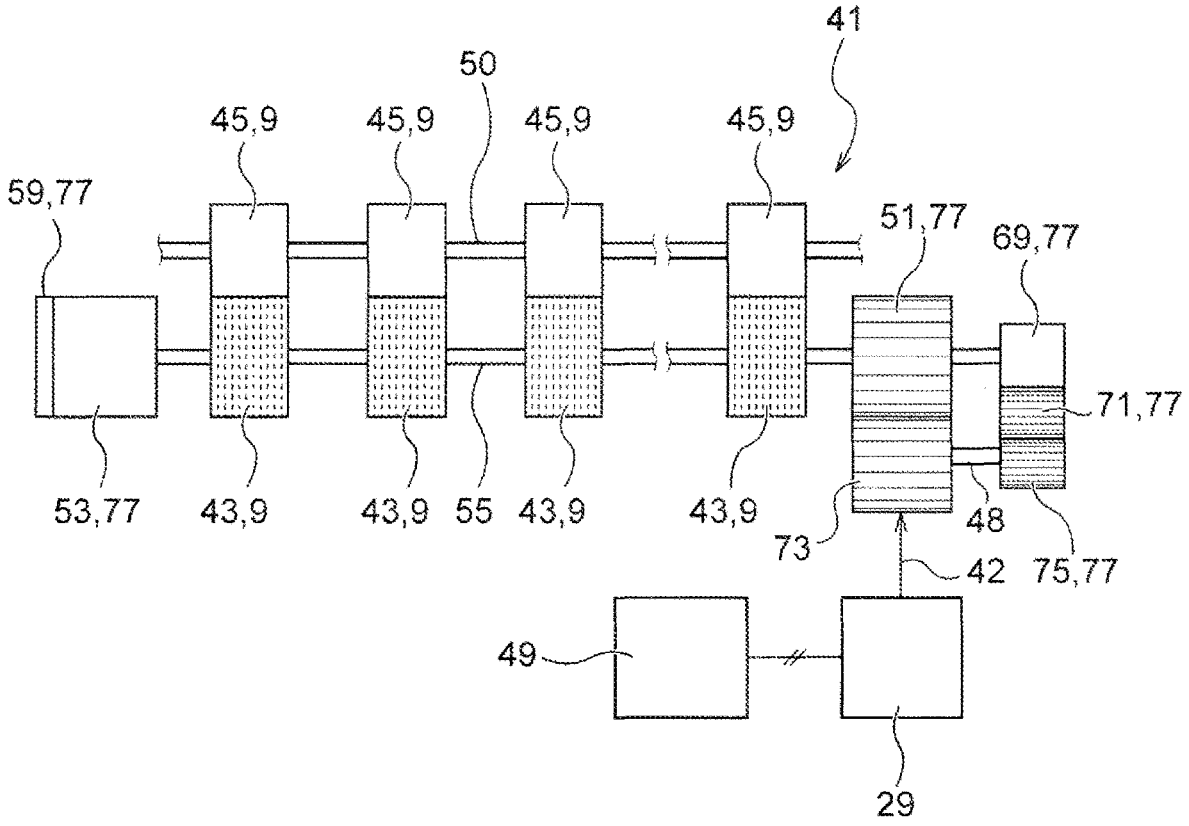
FIG. 5 is a plan view of a skew correction device according to a third exemplary embodiment.

The skew correction device 41 according to a third exemplary embodiment and the medium processing apparatus 1 including the skew correction device 41 are specifically described below with reference to FIG. 1 and FIG. 5. Parts similar to those of the first exemplary embodiment or the second exemplary embodiment are denoted with the same reference symbols, and the configurations and corresponding effects thereof are omitted in description.

Figure 4:
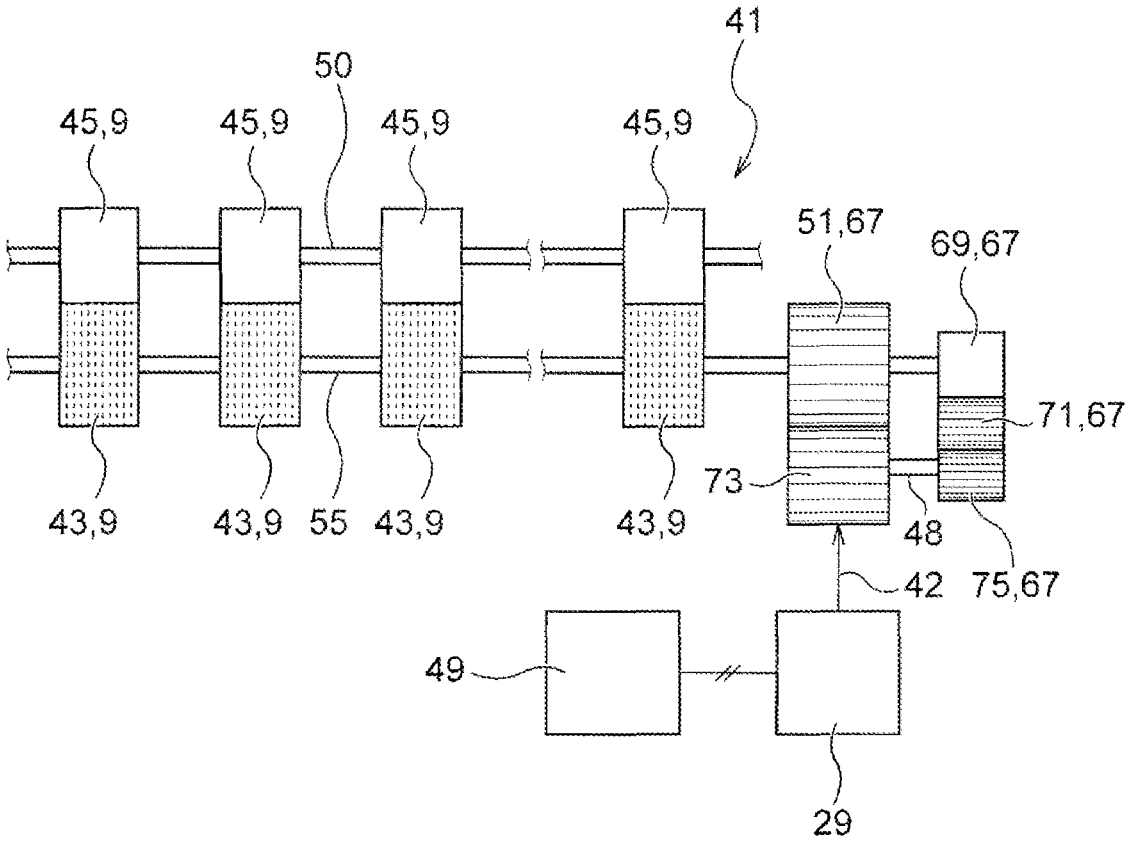
FIG. 4 is a plan view of a skew correction device according to a second exemplary embodiment.

The skew correction device 41 of the third exemplary embodiment corresponds to a configuration obtained by further adding the clutch 53, that is, the stoppage clutch 53 described in the first exemplary embodiment (FIG. 2) to the configuration of the second exemplary embodiment (FIG. 4). In other words, any one of an operation of correcting skew of the medium P during stoppage of the resist roller 43 and an operation of correcting skew of the medium P during reverse rotation of the resist roller 43 can be selected and performed.

In the present exemplary embodiment, a driving force transmission unit 77 is provided with the stoppage clutch 53 as a clutch that stops rotation of the resist roller 43 and the reverse-rotation clutch 69 that is in the cut-off state of not transmitting a driving force at the time of regular rotation of the resist roller 43 and is in the reverse-rotation clutch coupling state of transmitting a driving force at the time of reverse rotation of the resist roller 43.

Further, the idle gear 71 that is engaged with the reverse-rotation clutch 69 and transmits a driving force from the driving source 29 to the reverse-rotation clutch 69 is provided. The idle gear 71 reversely rotates the resist roller 43 in the reverse-rotation coupling state.

Similarly to the first exemplary embodiment, the driving force transmission unit 77 includes the regulation unit 59 that is coupled to the stoppage clutch 53 and thus regulates and stops rotation.

The driving force transmission unit 77 further includes the first toothed gear 73 that is engaged with the torque limiter 51 and transmits a driving force from the driving source 29 to the torque limiter 51, and the second toothed gear 75 that is engaged with the idle gear 71 and transmits a driving force from the driving source 29 to the idle gear 71. Here, the second toothed gear 75 is formed to have a diameter smaller than that of the first toothed gear 73. When the second toothed gear 75 has a diameter smaller than that of the first toothed gear 73, a speed of reverse rotation can be reduced without changing a rotation speed of the driving source 29.

In the present exemplary embodiment, the first toothed gear 73 and the second toothed gear 75 are provided to the shaft 48 that is coaxial, and are integrally rotated. In this case, the first toothed gear 73 receives a driving force from the driving source 29, and the second toothed gear 75 is rotated integrally with the first toothed gear 73. Similarly to the first exemplary embodiment, the first toothed gear 73 always transmits, to the torque limiter 51, a driving force of driving the resist roller 43 in the regular rotation direction. A driving force of driving the resist roller 43 in the reverse rotation direction is always transmitted to the reverse-rotation clutch 69 via the second toothed gear 75 and the idle gear 71.

At the time of regular rotation of the resist roller 43, the reverse-rotation clutch 69 receives the control signal from the control unit 49, and is in the dynamically non-coupling state with the roller shaft 55. With this, a driving force of the driving source 29 is transmitted to the resist roller 43 via the torque limiter 51, and thus the resist roller 43 is regularly rotated. In this state, the stoppage clutch 53 receives the control signal from the control unit 49, and is in the non-coupling state with the regulation unit 59, that is, the state of not stopping regular rotation of the resist roller 43.

Further, at the time of reverse rotation of the resist roller 43, the reverse-rotation clutch 69 receives the control signal from the control unit 49, and is in the dynamically coupling state with the roller shaft 55. With this, a driving force of the driving source 29 is transmitted to the resist roller 43 via the reverse-rotation clutch 69, and thus the resist roller 43 is reversely rotated. In this state, the stoppage clutch 53 receives the control signal from the control unit 49, and is in the non-coupling state with the regulation unit 59, that is, the state of not stopping reverse rotation of the resist roller 43.

Further, in any one of the cases of regular rotation and reverse rotation, the torque limiter 51 exceeds a set torque, and thus is in the slip state.

The medium processing apparatus 1 according to the third exemplary embodiment is basically similar to the medium processing apparatus 1 according to the first exemplary embodiment as described above. Configurations different from those of the first exemplary embodiment are described below.

In the medium processing apparatus 1 according to the third exemplary embodiment, the control unit 49 that controls the skew correction device 41 has the following control mode.

In the control mode, stoppage skew correction of correcting skew of the medium P in a state in which the stoppage clutch 53 stops the resist roller 43 can be performed. Further, reverse-rotation skew correction of correcting skew of the medium P in a state in which the reverse-rotation clutch 53 reversely rotates the resist roller 43 can be performed. Any one of the stoppage skew correction and the reverse-rotation skew correction is selected and performed.

Here, the stoppage skew correction is the skew correction described in the first exemplary embodiment, and hence description therefor is omitted. Further, the reverse-rotation skew correction is the skew correction described in the second exemplary embodiment, and hence description therefor is omitted.

Selection between the stoppage skew correction and the reverse-rotation skew correction can be easily performed by a user through an operation panel or the like, which is omitted in illustration.

In the present exemplary embodiment, when the reverse-rotation skew correction is performed, the control mode of the control unit 49 can be selected between the first reverse-rotation skew correction and the second reverse-rotation skew correction. In the first reverse-rotation skew correction, the leading edge of the medium P is caused to abut against the resist roller 43 during reverse rotation of the resist roller 43, and thus skew is corrected. In the second reverse-rotation skew correction, the resist roller 43 is reversely rotated after the leading edge of the medium P passes through the resist roller 43, and thus skew of the medium P is corrected. Selection between the first reverse-rotation skew correction and the second reverse-rotation skew correction may be easily performed by a user through an operation panel or the like, which is omitted in illustration. Alternatively, the control unit may be configured to perform selection, based on input information from a user or information relating to a printing job.

Here, the first reverse-rotation skew correction is the skew correction described in the second exemplary embodiment. Further, the second reverse-rotation skew correction is also the skew correction described in the second exemplary embodiment. Thus, description therefor is omitted.

Skew Correction of Skew Correction Device of Third Exemplary Embodiment

Any one of the stoppage skew correction in a state in which the control unit 49 stops the resist roller 43 and the reverse-rotation skew correction in a in which the resist roller 43 is reversely rotated is selected in advance by a user, and then is performed by the skew correction device 41 of the third exemplary embodiment. Moreover, when the reverse-rotation skew correction is selected, any one of the first reverse-rotation skew correction and the second reverse-rotation skew correction is selected in advance by a user, and is performed.

(1) Case in which Stoppage Skew Correction is Selected

In this case, the skew correction described in the first exemplary embodiment is performed. In this state, in any one of the cases of regular rotation of the resist roller 43 and stoppage of the resist roller 43, the reverse-rotation clutch 69 receives the control signal from the control unit 49, and is in the dynamically non-coupling state with the roller shaft 55. With this, the resist roller 43 is in a state of being dynamically cut off from the reverse-rotation clutch 69. Thus, the resist roller 43 can be regularly rotated or stopped, and the skew correction described in the first exemplary embodiment is performed.

(2) Case in which Reverse-Rotation Skew Correction is Selected (2-1) Case in which First Reverse-Rotation Skew Correction is Further Selected During Reverse Rotation Inclination Correction In this case, the first reverse-rotation skew correction described in the second exemplary embodiment is performed. In this state, the stoppage clutch 53 receives the control signal from the control unit 49, and is in the dynamically non-coupling state with the roller shaft 55. With this, the resist roller 43 is in a state of being dynamically cut off from the stoppage clutch 53. Thus, the resist roller 43 can be rotated in both the regular and reverse directions, and the first reverse-rotation skew correction described in the second exemplary embodiment is performed.

(2-2) Case in which Second Reverse-Rotation Skew Correction is Further Selected During Reverse Rotation Inclination Correction In this case, the second reverse-rotation skew correction described in the second exemplary embodiment is performed. In this state, the stoppage clutch 53 receives the control signal from the control unit 49, and is in the dynamically non-coupling state with the roller shaft 55. With this, the resist roller 43 is in a state of being dynamically cut off from the stoppage clutch 53. Thus, the resist roller 43 can be rotated in both the regular and reverse directions, and the second reverse-rotation skew correction described in the second exemplary embodiment is performed.

Description of Effects of Third Exemplary Embodiment (1) In the third exemplary embodiment, the skew correction device 41 includes the driving force transmission unit 77 that transmits a driving force from the driving source 29 via the torque limiter 51 and regularly drives the resist roller 43, and the stoppage clutch 53 and the reverse-rotation clutch 69 that perform switching between the state of regularly rotating the resist roller 43 and the state of reversely rotating the resist roller 43. The torque limiter 51, and the stoppage clutch 53 and the reverse-rotation clutch 69 are provided. Thus, effects similar to the effects based on the torque limiter 51 and the clutch 53 of the first exemplary embodiment can be exerted.

(2) Further, according to the present exemplary embodiment, the reverse-rotation clutch 69 is in the cut-off state, and the stoppage clutch 53 stops the resist roller 43. In this state, the torque limiter 51 exceeds a set torque, and thus is in the slip state. As a result, skew correction can be performed in a state in which the resist roller 43 is stopped.

Further, a restriction of the stoppage clutch 53 is canceled to allow the resist roller 43 to be in the rotatable state, and the reverse-rotation clutch 69 is in the reverse-rotation clutch coupling state. With this, the torque limiter 51 exceeds a set torque, and thus is in the slip state. As a result, skew correction can be performed in a state in which the reverse-rotation clutch 69 reversely rotates the resist roller 43. In other words, a method for skew correction can be selected as appropriate.

(3) Further, according to the present exemplary embodiment, the first toothed gear 73 and the second toothed gear 75 are coaxially provided. Thus, driving force transmission loss can be suppressed, and size reduction can be achieved.

(4) Further, according to the present exemplary embodiment, in the medium processing apparatus 1 that executes processing such as recording for the medium P, the above-mentioned effects based on the skew correction device 41 can be exerted. At the same time, skew correction can appropriately be performed, and accuracy of the processing can be improved.

(5) Further, according to the present exemplary embodiment, the control unit 49 can select between the stoppage skew correction and the reverse-rotation skew correction. With this, an appropriate skew correction method is selected in accordance with a type of the medium P, contents of the processing, a processing speed, or the like. Thus, skew correction can be performed more effectively. In particular, with a simple configuration, the plurality of skew correction methods can be selected and performed.

(6) Further, according to the present exemplary embodiment, at the time of performing the reverse-rotation skew correction, the control unit 49 can select between the first reverse-rotation skew correction and the second reverse-rotation skew correction. With this, an appropriate skew correction method is selected in accordance with a type of the medium P, contents of the processing, a processing speed, or the like. Thus, skew correction can be performed more effectively. In particular, with a simple configuration, the plurality of skew correction methods can be selected and performed.

(7) Further, according to the present exemplary embodiment, skew correction can appropriately be performed before the medium P to be subjected to recording is transported to the recording unit 12, and hence recording accuracy can be improved.

Further, the skew correction device 41 described above is used. In other words, the torque limiter 51 is used at the time of regular rotation transport. Thus, when a large transport resistance is caused downstream, the resist roller 43 cannot perform pressing by a torque larger than a set torque of the torque limiter 51. Therefore, when a jam of the medium P is caused in the periphery of the recording unit 12, the medium P can be prevented from being forcefully pressed, being deformed three-dimensionally, and contacting with the recording unit 12 to cause damage.

Similarly, the torque limiter 51 limits a force of pressing the medium P from behind, and hence a risk of disturbing a transport state of the medium can be suppressed. In particular, on the transport belt 18, a risk of disturbing a transport state of the medium P due to a transport force of the resist roller 43 can be suppressed.

Note that the effects can similarly be exerted even when the medium processing apparatus 1 includes a reading unit, a post-processing unit, or the like in place of the recording unit.

Fourth Exemplary Embodiment

Figure 6:
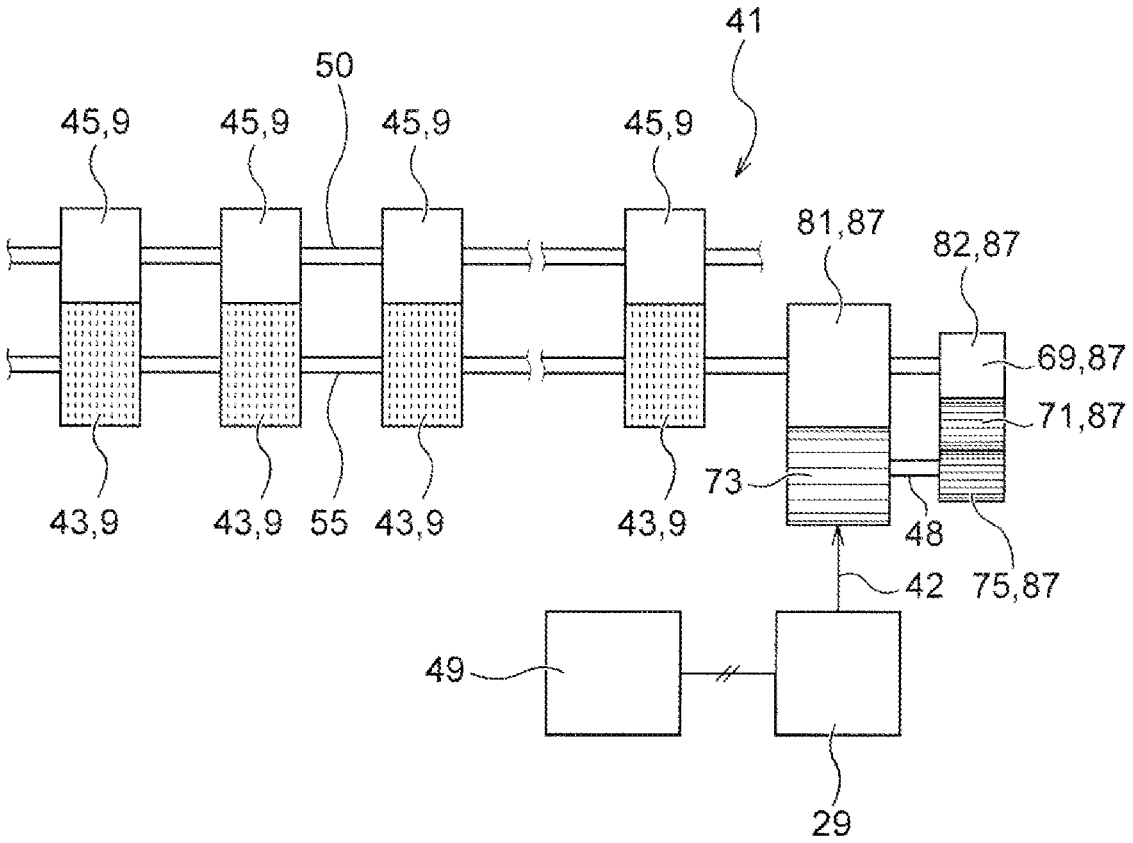
FIG. 6 is a plan view of a skew correction device according to a fourth exemplary embodiment.

The skew correction device 41 according to a fourth exemplary embodiment and the medium processing apparatus 1 including the skew correction device 41 are specifically described below with reference to FIG. 1 and FIG. 6. Parts similar to those of the first exemplary embodiment or the second exemplary embodiment are denoted with the same reference symbols, and the configurations and corresponding effects thereof are omitted in description.

The skew correction device 41 of the fourth exemplary embodiment corresponds to a structure obtained by changing the torque limiter 51 in the structure of the second exemplary embodiment (FIG. 4) to a regular-rotation clutch. The rest of the configurations is similar to those of the second exemplary embodiment.

In the present exemplary embodiment, a driving force transmission unit 87 includes a first clutch 81 and a second clutch 82. The first clutch 81 is in the coupling state of transmitting a driving force the time of regular rotation of the resist roller 43, and is in the cut-off state of not transmitting a driving force at the time of reverse rotation of the resist roller 43. The second clutch 82 is in the cut-off state of not transmitting a driving force at the time of regular rotation of the resist roller 43, and is in the coupling state of transmitting a driving force at the time of reverse rotation of the resist roller 43.

The first clutch 81 is a regular-reverse clutch for regularly rotating the resist roller 43. The second clutch 82 is for reversely rotating the resist roller 43, and corresponds to the reverse-rotation clutch 69 described above.

The driving force transmission unit 87 further includes the idle gear 71 that is engaged with the second clutch 82 and transmits a driving force from the driving source 29 to the second clutch 82, the first toothed gear 73 that is engaged with the first clutch 81 and transmits a driving force from the driving source 29 to the first clutch 81, and the second toothed gear 75 that is engaged with the idle gear 71 and transmits a driving force from the driving source 29 to the idle gear 71. Here, the second toothed gear 75 is formed to have a diameter smaller than that of the first toothed gear 73.

The first clutch 81 and the second clutch 82 are provided adjacent to each other to the roller shaft 55 that is coaxial. The first toothed gear 73 and the second toothed gear 75 are provided to the shaft 48 that is coaxial, and are integrally rotated. In this case, the first toothed gear 73 receives a driving force from the driving source 29, and the second toothed gear 75 is rotated integrally with the first toothed gear 73.

The first toothed gear 73 always transmits, to the first clutch 81 being a regular-rotation clutch, a driving force of driving the resist roller 43 in the regular rotation direction. Similarly to the second exemplary embodiment, a driving force of driving the resist roller 43 in the reverse rotation direction is always transmitted to the second clutch 82, that is, the reverse-rotation clutch 69 via the second toothed gear 75 and the idle gear 71.

At the time of regular rotation of the resist roller 43, the first clutch 81 receives the control signal from the control unit 49, and is in the dynamically coupling state with the roller shaft 55. In this state, the second clutch 82, that is, the reverse-rotation clutch 69 receives the control signal from the control unit 49, and is in the dynamically non-coupling state with the roller shaft 55. With this, a driving force of the driving source 29 is transmitted to the resist roller 43 via the first clutch 81, and the resist roller 43 is regularly rotated.

At the time of reverse rotation of the resist roller 43, the second clutch 82, that is, the reverse-rotation clutch 69 receives the control signal from the control unit 49, and is in the dynamically coupling state with the roller shaft 55. In this state, the first clutch 81 receives the control signal from the control unit 49, and is in the dynamically non-coupling state with the roller shaft 55. With this, a driving force of the driving source 29 is transmitted to the resist roller 43 via the second clutch 82, that is, the reverse-rotation clutch 69, and thus the resist roller 43 is reversely rotated.

The medium processing apparatus 1 according to the fourth exemplary embodiment is basically similar to the medium processing apparatus 1 according to the first exemplary embodiment as described above. Configurations different from those of the first exemplary embodiment are described below.

In the medium processing apparatus 1 according to the fourth exemplary embodiment, the control unit 49 that controls the skew correction device 41 has the following control mode.

The control mode enables selection between the first reverse-rotation skew correction and the second reverse-rotation skew correction. In the first reverse-rotation skew correction, the leading edge of the medium P is caused to abut against the resist roller 43 during reverse rotation of the resist roller 43, and thus skew is corrected. In the second reverse-rotation skew correction, the resist roller 43 is reversely rotated after the leading edge of the medium P passes through the resist roller 43, and thus skew of the medium P is corrected. Selection between the first reverse-rotation skew correction and the second reverse-rotation skew correction can be easily performed by a user through an operation panel or the like, which is omitted in illustration.

Here, the first reverse-rotation skew correction is the skew correction described in the second exemplary embodiment. Further, the second reverse-rotation skew correction is also the skew correction described in the second exemplary embodiment. Thus, description therefor is omitted.

Skew Correction of Skew Correction Device of Fourth Exemplary Embodiment

The skew correction device 41 of the fourth exemplary embodiment corrects skew of the medium P with the control unit 49 in the following manner in a state in which the resist roller 43 is regularly rotated. In this state, a user selects any one of the first reverse-rotation skew correction and the second reverse-rotation skew correction in advance.

(1) Case in which First Reverse-Rotation Skew Correction is Selected (1-1) When the leading edge of the medium P transported through the upstream transport unit 61 arrives at the position right before the transport roller pair 9, a sensor, which is omitted in illustration, detects the leading edge. In response to the detection signal, the control unit 49 transmits the control signal to the second clutch 82, that is, the reverse-rotation clutch 69. With this, the reverse-rotation clutch 69 is switched to the coupling state, that is, the dynamically coupling state with the roller shaft 55, and reversely rotates the resist roller 43. In this state, the first clutch 81 being a regular-rotation clutch is switched to the cut-off state. Moreover, the leading edge of the medium P is caused to abut against the resist roller 43 at the nipping position during reverse rotation of the resist roller 43.

(1-2) After that, the leading edge of the medium P being transported abuts against the nipping position between the resist roller 43 and the driven roller 45 that are reversely rotated, and movement of the leading edge in the transport direction is stopped. In this state, the medium P receives a transport force from the transport roller pair 7 and the like positioned upstream, and is bent to a small degree. Then, skew correction progresses.

(1-3) Moreover, after a predetermined time period that is set in advance for skew correction elapses, the control unit 49 transmits the control signal to the reverse-rotation clutch 69, and the reverse-rotation clutch 69 is switched to the cut-off state, that is, the dynamically non-coupling state with the roller shaft 55. Further, the first clutch 81 being a regular-rotation clutch is switched to the coupling state, that is, the dynamically coupling state with the roller shaft 55, and regularly rotates the resist roller 43. In other words, regular rotation of the resist roller 43 is started again, and the medium P is transported to the recording unit 12. The recording unit 12 performs recording on the medium P after skew correction.

(2) Case in which Second Reverse-Rotation Skew Correction is Selected (2-1) In a state in which a sensor, which is omitted in illustration, detects the leading edge of the medium P being transported through the upstream transport unit 61, the leading edge of the medium P arrives at the nipping position of the resist roller 43 being regularly rotated, passes therethrough, and is further fed by a predetermined amount in the transport direction. Then, the control unit 49 transmits the control signal to the second clutch 82, that is, the reverse-rotation clutch 69. In response to the control signal, the reverse-rotation clutch 69 is in the coupling state, and the resist roller 43 is changed from the regular rotation state to the reverse rotation state. In this state, the first clutch 81 being a regular-rotation clutch is switched to the cut-off state.

(2-2) The resist roller 43 is reversely rotated, and thus the leading edge of the medium P is returned upstream of the nipping position. In this state, the medium P is in a state in which a part thereof positioned upstream of the nipping position receives a transport force in the regular rotation direction from the transport roller pair 7 and the like and a part thereof positioned downstream of the nipping position receives a transport force in the reverse rotation direction from the reverse-rotation clutch 69. Thus, skew correction progresses effectively.

(2-3) Moreover, after the entire leading edge of the medium P is returned upstream of the nipping position, the control unit 49 transmits the control signal to the reverse-rotation clutch 69. Then, the reverse-rotation clutch 69 is switched to the cut-off state. Further, the first clutch 81 being a regular-rotation clutch is switched to the coupling state, and regularly rotates the resist roller 43. In other words, regular rotation of the resist roller 43 is started again, and the medium P is transported to the recording unit 12. The recording unit 12 performs recording on the medium P after skew correction.

Description of Effects of Fourth Exemplary Embodiment (1) According to the present exemplary embodiment, the driving force transmission unit 87 transmits a driving force from the driving source 29 to the resist roller 43 via the first clutch 81 being a regular-rotation clutch, the second clutch 82 being the reverse-rotation clutch 69, the idle gear 71, the first toothed gear 73, and the second toothed gear 75. With this, when the resist roller 43 is regularly rotated, the first clutch 81 is in the cut-off state. Thus, a load applied from the resist roller 43 at the time of regular rotation transport is suppressed. Further, as compared to a configuration in which a motor is regularly/reversely rotated, a time period required for acceleration of the motor is not required. Thus, a throughput can be improved.

Further, the first clutch 81 and the second clutch 82 are coaxially provided. Thus, driving force transmission loss can be suppressed, and size reduction can be achieved. Further, the first toothed gear 73 and the second toothed gear 75 are coaxially provided. Thus, driving force transmission loss can be suppressed, and size reduction can be achieved.

(2) Further, according to the present exemplary embodiment, in the medium processing apparatus 1 that executes processing such as recording for the medium P, the above-mentioned effects based on the skew correction device 41 can be exerted. At the same time, skew correction can appropriately be performed, and accuracy of the processing can be improved.

(3) Further, according to the present exemplary embodiment, the control unit 49 can select between the first reverse-rotation skew correction and the second reverse-rotation skew correction. With this, an appropriate skew correction method is selected in accordance with a type of the medium P, contents of the processing, a processing speed, or the like. Thus, skew correction can be performed more effectively. In particular, with a simple configuration, the plurality of skew correction methods can be selected and performed.

Other Exemplary Embodiments

The recording device according to the present disclosure basically includes the configurations of the exemplary embodiments described above. As a matter of course, the configurations may be partially changed or omitted within a range that does not deviate from the gist of the disclosure of the present application.

In the exemplary embodiments described above, description is made on the medium processing apparatus 1 being a recording apparatus including the recording unit 12, specifically, an ink-jet type printer. The exemplary embodiments are applicable to other recording apparatus. Further, the medium processing apparatus 1 is also applicable to a recording system or the like including a reading device such as a scanner and an ADF, a finisher, and a relay unit.

Further, the skew correction device 41 according to the second exemplary embodiment to the fourth exemplary embodiment is configured to perform the first reverse-rotation skew correction and the second reverse-rotation skew correction, but is not necessarily required to perform both the corrections. In other words, the skew correction device may only perform any one of the reverse skew corrections. Similarly, the skew correction device 41 according to the second exemplary embodiment to the fourth exemplary embodiment is not necessarily required to perform selection and switching between the first reverse-rotation skew correction and the second reverse-rotation skew correction.

Further, the skew correction device 41 according to the third exemplary embodiment is configured to perform the stoppage skew correction and the reverse skew correction, but is not necessarily required to perform both the corrections. In other words, the skew correction device may only perform any one of the skew corrections. Similarly, the skew correction device 41 according to the third exemplary embodiment is not necessarily required to perform selection and switching between the stoppage skew correction and the reverse skew correction.

The torque limiter 43 of the first exemplary embodiment is arranged at the one end of the roller shaft 55, and the clutch 53 is arranged at the other end of the roller shaft 55. Alternatively, the torque limiter 43 and the clutch 53 may be arranged at one end of the roller shaft. In other words, the torque limiter 43 and the clutch 53 may be arranged on the same side with respect to the center of the roller shaft.

With this configuration, a space can be saved, and assembly can also be facilitated.

Similarly, in the third exemplary embodiment, the torque limiter 43 and the stoppage clutch 53 may also be arranged on the same side with respect to the center of the roller shaft.

In the third exemplary embodiment, the stoppage clutch 53 and the reverse-rotation clutch 69 may be provided as one clutch. In other words, the reverse-rotation clutch 69 may also function as the stoppage clutch 53. For example, the regulation unit 59 may be provided in an advancing/retracting manner between a regulation state and a retraction state with respect to the reverse-rotation clutch 69 illustrated in FIG. 5.

With this configuration, the number of clutch can be reduced. At the same time, various types of skew correction can be performed with a simple configuration.

In another expression, in the second exemplary embodiment, the reverse-rotation clutch 69 may also function as the stoppage clutch 53. For example, the regulation unit 59 may be provided in an advancing/retracting manner between a regulation state and a retraction state with respect to the reverse-rotation clutch 69 illustrated in FIG. 4.

With this configuration, stoppage skew correction can also be performed in addition to reverse skew correction without increasing the number of clutches.

In further another expression, in the first exemplary embodiment, the stoppage clutch 53 may also function as the reverse-rotation clutch 69. For example, the stoppage clutch 53 illustrated in FIG. 2 may be provided with the idle gear 71 that transmits a driving force or the like.

With this configuration, reverse-rotation skew correction can also be performed in addition to stoppage skew correction without increasing the number of clutches.

Similarly, in the fourth exemplary embodiment, the reverse-rotation clutch 69 may also function as the stoppage clutch 53. For example, the regulation unit 59 may be provided in an advancing/retracting manner between a regulation state and a retraction state with respect to the reverse-rotation clutch 69 illustrated in FIG. 6.

With this configuration, stoppage skew correction can also be performed in addition to reverse skew correction without increasing the number of clutches.

Further, a time period required for a reverse rotation operation or a stoppage operation of the resist roller 43 includes timing before the medium P abuts against the nipping position, the abutting, and an elapse of a predetermined time period. The distance between the media P is reduced for high-speed transport, and the medium P is transported at as short an interval as possible. With this, a time period for regular-rotation transport is longer than the time period for the reverse rotation operation or the stoppage operation of the resist roller 43.

Thus, in the related-art sheet transport device, a time period during which the resist roller is driven via the clutch is increased, and the idling time period of the torque limiter is increased. With this, the clutch or the torque limiter is worn quickly, which may cause a risk of degrading.

According to the first exemplary embodiment, the second exemplary embodiment, and the third exemplary embodiment, a risk of wearing the clutch or the torque limiter can be reduced.

What is claimed is:

1. A skew correction device for transporting a medium through regular rotation of a resist roller and correct skew of the medium through reverse rotation or stoppage of the resist roller, the skew correction device comprising:

the resist roller is configured to rotate about a roller shaft integrally with the roller shaft;

a driven roller configured to transport the medium by nipping the medium together with the resist roller and correct skew of the medium; and a driving force transmission unit configured to transmit a driving force from a driving source to the resist roller, wherein the driving force transmission unit includes:

a torque limiter configured to regularly rotate the resist roller by transmitting the driving force from the driving source; and a clutch configured to perform switching between a state of regularly rotating the resist roller and a state of reversely rotating or stopping the resist roller, wherein the torque limiter and the clutch are disposed on the roller shaft which is common to both the torque limiter and the clutch, the clutch includes:

a stoppage clutch configured to stop rotation of the resist roller; and a reverse-rotation clutch being in a cut-off state of not transmitting a driving force at a time of regular rotation of the resist roller and being in a reverse-rotation coupling state of transmitting a driving force at the time of reverse rotation of the resist roller, the driving force transmission unit includes an idle gear being engaged with the reverse-rotation clutch and being configured to transmit a driving force from the driving source to the reverse-rotation clutch, and the idle gear reversely rotates the resist roller in the reverse-rotation coupling state.

2. The skew correction device according to claim 1, wherein the torque limiter and one of the reverse-rotation clutch and the stoppage clutch are provided on the same side with respect to a center of the roller shaft.

3. The skew correction device according to claim 1, wherein the resist roller is a toothed roller.

4. The skew correction device according to claim 1, comprising:

a regulation unit being engaged with the clutch and being configured to regulate rotation of the clutch, wherein skew of the medium is corrected in a state in which the resist roller is stopped.

5. A medium processing apparatus, comprising:

the skew correction device of claim 4;

a driving source configured to drive the resist roller;

an upstream transport unit configured to transport the medium to the skew correction device;

a downstream transport unit configured to transport the medium after skew correction performed by the skew correction device; and a processing unit configured to execute processing on the medium transported by the downstream transport unit.

6. The skew correction device according to claim 1, wherein the reverse-rotation clutch is configured to reverse rotation of the resist roller, and skew of the medium is corrected in a state in which the resist roller is reversely rotated.

7. The skew correction device according to claim 6, wherein the driving force transmission unit includes:

a first toothed gear being engaged with the torque limiter and being configured to transmit a driving force from the driving source to the torque limiter; and a second toothed gear being engaged with the idle gear and being configured to transmit a driving force from the driving source to the idle gear, the first toothed gear and the second toothed gear are coaxially provided, one of the first toothed gear and the second toothed gear receives a driving force from the driving source, and another one of the first toothed gear and the second toothed gear is integrally rotated with the one thereof.

8. The skew correction device according to claim 7, wherein the second toothed gear has a diameter smaller than that of the first toothed gear.

9. A medium processing apparatus, comprising:

the skew correction device of claim 6;

the driving source configured to drive the resist roller;

an upstream transport unit configured to transport the medium to the skew correction device;

a downstream transport unit configured to transport the medium after skew correction performed by the skew correction device; and a processing unit configured to execute processing on the medium transported by the downstream transport unit.

10. The medium processing apparatus according to claim 9, comprising:

a control unit configured to control the skew correction device, wherein the control unit is configured to select between:

a first reverse-rotation skew correction for correcting skew by causing a leading edge of the medium to abut against a resist roller in a state in which the resist roller is reversely rotated; and a second reverse-rotation skew correction for correcting skew of the medium by reversely rotating the resist roller after the leading edge of the medium passes through the resist roller.

11. The skew correction device according to claim 1, wherein the driving force transmission unit includes:

a first toothed gear being engaged with the torque limiter and being configured to transmit a driving force from the driving source to the torque limiter; and a second toothed gear being engaged with the idle gear and being configured to transmit a driving force from the driving source to the idle gear, the first toothed gear and the second toothed gear are coaxially provided, one of the first toothed gear and the second toothed gear receives a driving force from the driving source, and another one of the first toothed gear and the second toothed gear is integrally rotated with the one thereof.

12. A medium processing apparatus, comprising:

the skew correction device of claim 1;

a driving source configured to drive the resist roller;

an upstream transport unit configured to transport the medium to the skew correction device;

a downstream transport unit configured to transport the medium after skew correction performed by the skew correction device; and a processing unit configured to execute processing on the medium transported by the downstream transport unit.

13. The medium processing apparatus according to claim 12, comprising a control unit configured to control the skew correction device, wherein the control unit is configured to select between:

a stoppage skew correction for correcting skew of the medium in a state in which the stoppage clutch stops the resist roller; and a reverse-rotation skew correction for correcting skew of the medium in a state in which the reverse-rotation clutch reversely rotates the resist roller.

14. The medium processing apparatus according to claim 13, wherein the control unit is configured to, when performing the reverse-rotation skew correction, select between:

a first reverse-rotation skew correction for correcting skew by causing a leading edge of the medium to abut against a resist roller in a state in which the resist roller is reversely rotated; and a second reverse-rotation skew correction for correcting skew of the medium by reversely rotating the resist roller after the leading edge of the medium passes through the resist roller.

15. A skew correction device for transporting a medium through regular rotation of a resist roller and correct skew of the medium through reverse rotation or stoppage of the resist roller, the skew correction device comprising:

the resist roller is configured to rotate about a roller shaft integrally with the roller shaft;

a driven roller configured to transport the medium by nipping the medium together with the resist roller and correct skew of the medium; and a driving force transmission unit configured to transmit a driving force from a driving source to the resist roller, wherein the driving force transmission unit includes:

a first clutch being in a coupling state of transmitting a driving force at the time of regular rotation of the resist roller and being in a cut-off state of not transmitting a driving force at the time of reverse rotation of the resist roller;

a second clutch being in a cut-off state of not transmitting a driving force at the time of regular rotation of the resist roller and being in a coupling state of transmitting a driving force at the time of reverse rotation of the resist roller, the first clutch and the second clutch being coaxial with the roller shaft;

an idle gear being engaged with the second clutch and being configured to transmit a driving force from the driving source to the second clutch;

a first toothed gear being engaged with the first clutch and being configured to transmit a driving force from the driving source to the first clutch; and a second toothed gear being engaged with the idle gear and being configured to transmit a driving force from the driving source to the idle gear, the first clutch and the second clutch are coaxially provided, the first toothed gear and the second toothed gear are coaxially provided, one of the first toothed gear and the second toothed gear receives a driving force from the driving source, and another one of the first toothed gear and the second toothed gear is integrally rotated with the one thereof.

16. A medium processing apparatus, comprising:

the skew correction device of claim 15;

a driving source configured to drive the resist roller;

an upstream transport unit configured to transport the medium to the skew correction device;

a downstream transport unit configured to transport the medium after skew correction performed by the skew correction device; and a processing unit configured to execute processing on the medium transported by the downstream transport unit.

17. The medium processing apparatus according to claim 16, comprising:

a control unit configured to control the skew correction device, wherein the control unit is configured to select between:

a first reverse-rotation skew correction for correcting skew by causing a leading edge of the medium to abut against a resist roller in a state in which the resist roller is reversely rotated; and a second reverse-rotation skew correction for correcting skew of the medium by reversely rotating the resist roller after the leading edge of the medium passes through the resist roller.

* * * * *